US012529296B2

(12) United States Patent
Olorode et al.

(10) Patent No.: US 12,529,296 B2
(45) Date of Patent: Jan. 20, 2026

(54) SYSTEM AND METHOD FOR USING CONTROLLED FRACTURES IN ENHANCED GEOTHERMAL SYSTEMS

(71) Applicant: Board of Supervisors of Louisiana State University and Agricultural and Mechanical College, Baton Rouge, LA (US)

(72) Inventors: Olufemi M. Olorode, Baton Rouge, LA (US); Harun U. Rashid, Baton Rouge, LA (US)

(73) Assignee: Board of Supervisors of Louisiana State University and Agricultural and Mechanical College, Baton Rouge, LA (US)

( * ) Notice: Subject to any disclaimer, the term of this patent is extended or adjusted under 35 U.S.C. 154(b) by 0 days.

(21) Appl. No.: 18/431,730

(22) Filed: Feb. 2, 2024

(65) Prior Publication Data

US 2024/0280295 A1 Aug. 22, 2024

Related U.S. Application Data

(60) Provisional application No. 63/443,221, filed on Feb. 3, 2023.

(51) Int. Cl.
*E21B 43/17* (2006.01)
*E21B 7/00* (2006.01)
(Continued)

(52) U.S. Cl.
CPC ..... *E21B 43/17* (2013.01); *E21B 7/00* (2013.01); *E21B 11/06* (2013.01); *E21B 43/267* (2013.01); *F24T 10/20* (2018.05); *F24T 2010/53* (2018.05)

(58) Field of Classification Search
CPC ..... E21B 43/17; E21B 7/00; E21B 11/06; E21B 43/267; F24T 10/20; F24T 2010/53
See application file for complete search history.

(56) References Cited

U.S. PATENT DOCUMENTS

2007/0158072 A1* 7/2007 Coleman ..... E21C 25/00 166/298
2007/0223999 A1* 9/2007 Curlett ..... F24T 10/20 405/55

(Continued)

OTHER PUBLICATIONS

Rashid, Harun & Olorode, Olufemi. (2024). Use of controlled fractures in enhanced geothermal systems. Advances in Geo-Energy Research. 12. 35-51. 10.46690/ager.2024.04.04.

*Primary Examiner* — Neel Girish Patel
(74) *Attorney, Agent, or Firm* — Thomas Horstemeyer LLP.

(57) ABSTRACT

Disclosed are various approaches for using controlled fractures in geothermal systems. In some examples, a method includes drilling at least one injection well bore. The method can also include cutting at least a first slot at an angle to the injection well bore, where the first slot has a first end connected to the injection well bore and a distal end. The method can include cutting at least a second slot at an angle to the injection well bore, where the second slot has a first end connected to the distal end of the first slot and a distal end. The method can also include drilling at least one production well bore, where the production well bore is connected to the distal end of the second slot.

9 Claims, 28 Drawing Sheets

(51) Int. Cl.

| | |
|---|---|
| ***E21B 11/06*** | (2006.01) |
| ***E21B 43/267*** | (2006.01) |
| ***F24T 10/00*** | (2018.01) |
| ***F24T 10/20*** | (2018.01) |

(56) References Cited

U.S. PATENT DOCUMENTS

| | | | | |
|---|---|---|---|---|
| 2010/0078220 | A1* | 4/2010 | Coleman, II | E21C 25/20 175/89 |
| 2011/0247816 | A1* | 10/2011 | Carter, Jr. | E21B 43/26 166/298 |
| 2013/0341029 | A1* | 12/2013 | Roberts | E21B 43/263 166/308.1 |
| 2015/0096806 | A1* | 4/2015 | Fonseca Ocampos | E21B 7/00 175/91 |
| 2015/0300327 | A1* | 10/2015 | Sweatman | F24T 10/20 60/641.2 |
| 2017/0321934 | A1* | 11/2017 | Krüger | E21B 47/06 |

* cited by examiner

Proposed geometry for the 14 SDF doublet

Geometry for the nine fracture MHF

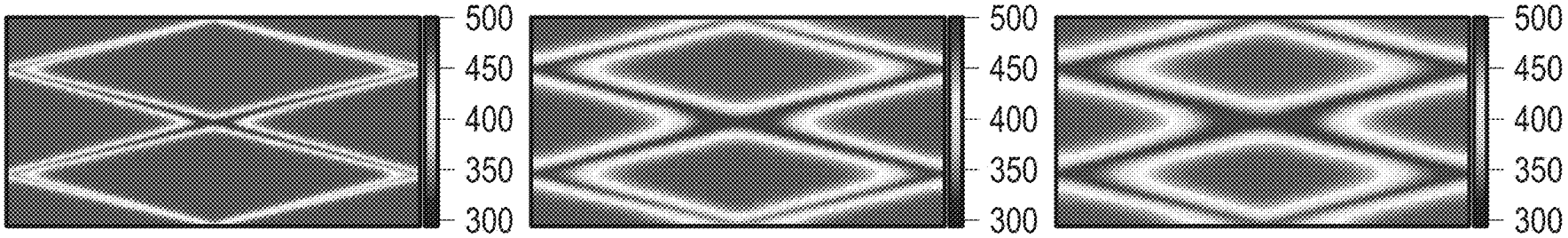
SDF triplet after 10 years
FIG. 13A
SDF triplet after 30 years
FIG. 13B
SDF triplet after 50 years
FIG. 13C
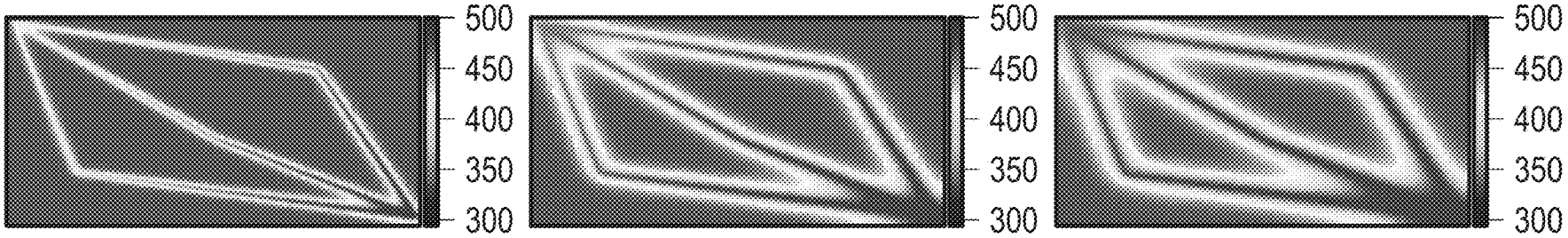
SDF doublet after 10 years
FIG. 13D
SDF doublet after 30 years
FIG. 13E
SDF doublet after 50 years
FIG. 13F
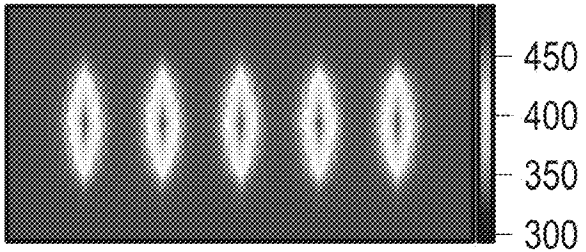
MHF after 10 years
FIG. 13G
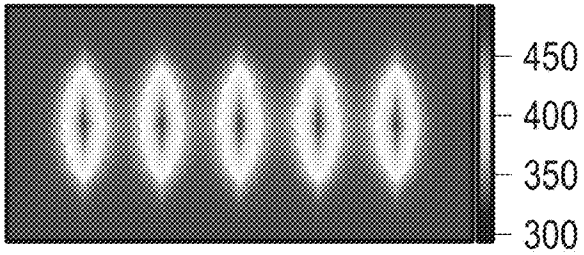
MHF after 30 years
FIG. 13H
MHF after 50 years
FIG. 13I Comparison of produced thermal energy for the extended cases Comparison of the produced fluid temperature for the extended cases Comparison of thermal recovery fraction for the extended cases Temperature profile for the nine fracture MHF Temperature profile for the 14 SDF doublet Simulation domain for Eight SDF triplet with 160 natural fractures Simulation domain for Five MHF with 160 natural fractures Simulation domain for Five MHF with 375 natural fractures Simulation domain for Eight SDF triplet with 375 natural fractures Temperature profile for MFHW 160 NF case at the top of the reservoir Temperature profile for SDF 160 NF case at the top of the reservoir Comparison of cumulative thermal energy for natural fracture cases Comparison of produced fluid temperature for natural fracture cases Comparison of recovery factor for natural fracture cases Natural fractures are only creating intersection with the SD fracture Natural fractures have created short circuits of the flow path Comparison of cumulative thermal energy for short circuit cases Comparison of produced fluid temperature for short circuit cases Comparison of recovery factor for short circuit cases Use SD EGS in Utah Forge with 500 natural fractures Use multi-stage hydraulic fracturing in Utah Forge with 500 natural fractures Temperature profile in MHF fracture case for Utah Forge EGS Temperature profile in SD fracture case for Utah Forge EGS Comparison of the cumulative thermal energy profile Comparison of produced fluid temperature profile Comparison of recovery fraction after 50 years of simulated production

SYSTEM AND METHOD FOR USING CONTROLLED FRACTURES IN ENHANCED GEOTHERMAL SYSTEMS

CROSS REFERENCE TO RELATED APPLICATIONS

This application claims priority to, and the benefit of, U.S. provisional application entitled "System and Method for Using Controlled Fractures in Enhanced Geothermal Systems" having Ser. No. 63/443,221, filed Feb. 3, 2023, which is hereby incorporated by reference in its entirety.

BACKGROUND

Enhanced (or Engineered) Geothermal Systems are systems designed to extract heat from the earth for power generation. In hydrothermal systems, naturally occurring hot water or steam reservoirs beneath the surface of the earth are tapped into and the hot water or steam is brought to the surface to generate electricity. Hydrothermal systems require heat, water, and permeability of the underground rock. EGS can be used when rock permeability is low to create man-made reservoirs.

BRIEF DESCRIPTION OF DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

FIG. 3(*b*) shows an example of one arrangement of a plurality of interconnected slots according to various embodiments of the present disclosure.

FIG. 9(*a*) is comparison of the produced fluid temperature. FIG. 9(*b*) is a comparison of cumulative thermal energy. FIG. 9(*c*) is a comparison of recovery fraction.

FIG. 11(*b*) is an example of a temperature profile of a production well according to various embodiments of the present disclosure.

FIG. 12(*a*) is a comparison of the thermal energy produced; FIG. 12(*b*) is a comparison of the produced fluid temperature; FIG. 12(*c*) is a comparison of recovery fraction.

FIGS. 13(*a*)-(*i*) are example profiles showing the evolution of temperature distribution at the top of a reservoir after 10, 30, and 50 years according to various embodiments of the present disclosure.

DETAILED DESCRIPTION

Figure 1:
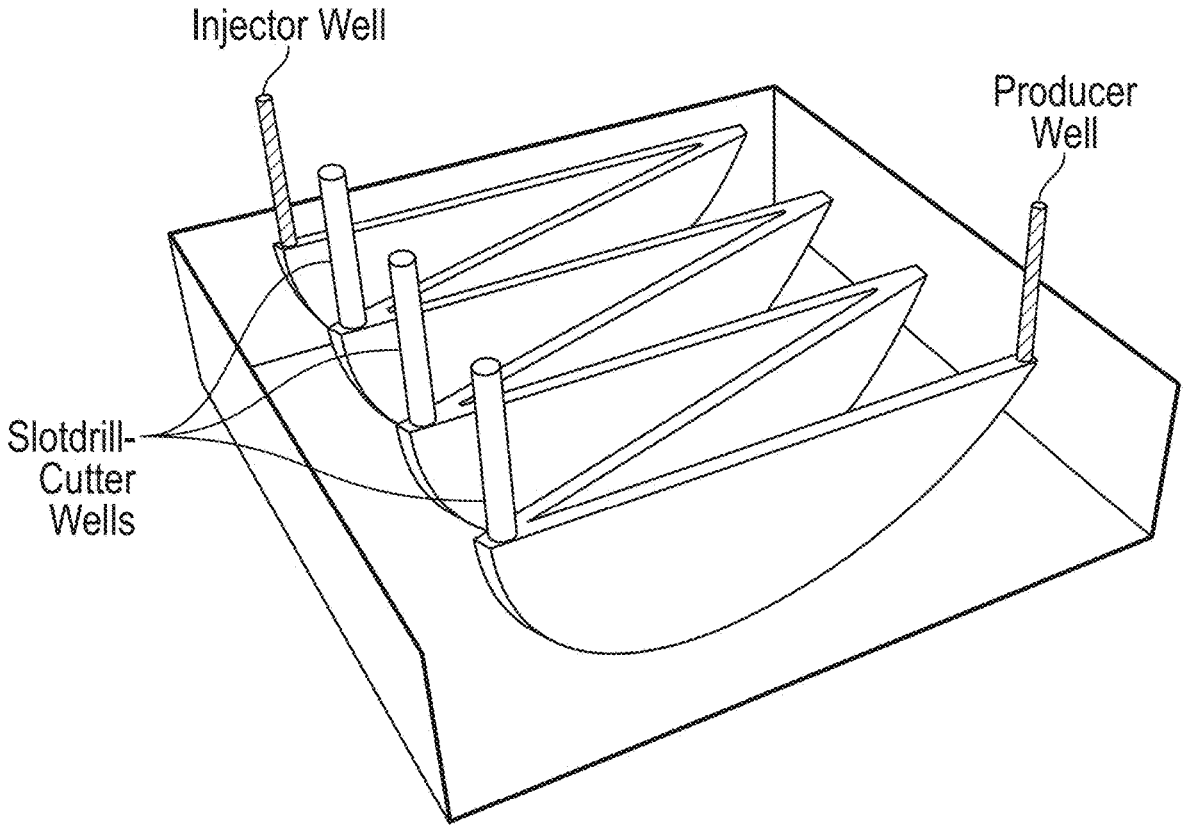
FIG. 1 shows an example of a plurality of interconnected slots according to various embodiments of the present disclosure.

In accordance with the purpose(s) of the present disclosure, as embodied and broadly described herein, embodiments of the present disclosure, in some aspects, relate to systems and methods for using controlled fractures in geothermal systems. In general, embodiments of the present disclosure provide for methods of cutting slots in subsurface rock, injecting water into the slots, and producing heated water.

Before the present disclosure is described in greater detail, it is to be understood that this disclosure is not limited to particular embodiments described, and as such may, of course, vary. It is also to be understood that the terminology used herein is for the purpose of describing particular embodiments only, and is not intended to be limiting, since the scope of the present disclosure will be limited only by the appended claims.

Disjunctive language such as the phrase "at least one of X, Y, or Z," unless specifically stated otherwise, is otherwise understood with the context as used in general to present that an item, term, etc., can be either X, Y, or Z, or any combination thereof (e.g., X; Y; Z; X or Y; X or Z; Y or Z; X, Y, or Z; etc.). Thus, such disjunctive language is not generally intended to, and should not, imply that certain embodiments require at least one of X, at least one of Y, or at least one of Z to each be present.

Discussion

The present disclosure provides for methods of extracting heat from the earth for power generation, using in heating systems, and the like. In addition, the present disclosure provides systems that can extract heat from the earth for power generation, heating systems and the like. The present disclosure uses controlled fractures in a well, where water is flowed through the controlled fracture and the temperature of the water is increased. The heated water is then flowed out of the well and can be used as desired. The present disclosure is advantageous in that heat from the earth can be efficiently acquired using water and the process does not produce emissions.

In some embodiments, the method uses controlled fractures in geothermal systems to transport heat from the earth to water, where the water is then circulated to the surface where the thermal energy can be used. The method includes drilling at least one injection well bore and then cutting a plurality of slots away from the injection well bore to form the controlled fractures. The slots can be connected serially and/or in parallel. The slots are fluidically connected to the injection well bore and the production well bore so that water can flow from the injection well bore to the production well bore. In some embodiments, the injection well bore can be a substantially (e.g., +/−25%) vertical well bore into the earth. In some embodiments, the slots are cut substantially (e.g., +/−45%) perpendicular to the injection well bore. In some embodiments, the slots are cut and connected in series such that a flow-path for water is formed through the slots to flow water from the first slot through the middle slots and to the end slots. In other embodiments, the slots are cut and connected in parallel. In still other embodiments, some slots are cut in serials and others in parallel. The flow-path can be formed between the injection well bore at the first end and the production well bore at the second end. In some embodiments, the slots can be cut away from the injection well bore in multiple directions and feed multiple different production well bores, in series, in parallel, or a combination of in series and parallel. In each embodiment the injection well bore, the one or more slots, and the production well bore are in fluidic communication so that water is flowed into the injection well bore, through the one or more slots, and out of the production well bore.

Figure 2:
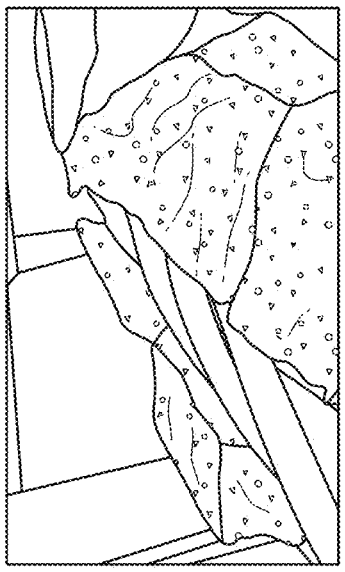
FIG. 2 shows an example of one method to drill slots according to various embodiments of the present disclosure.
Figure 2:
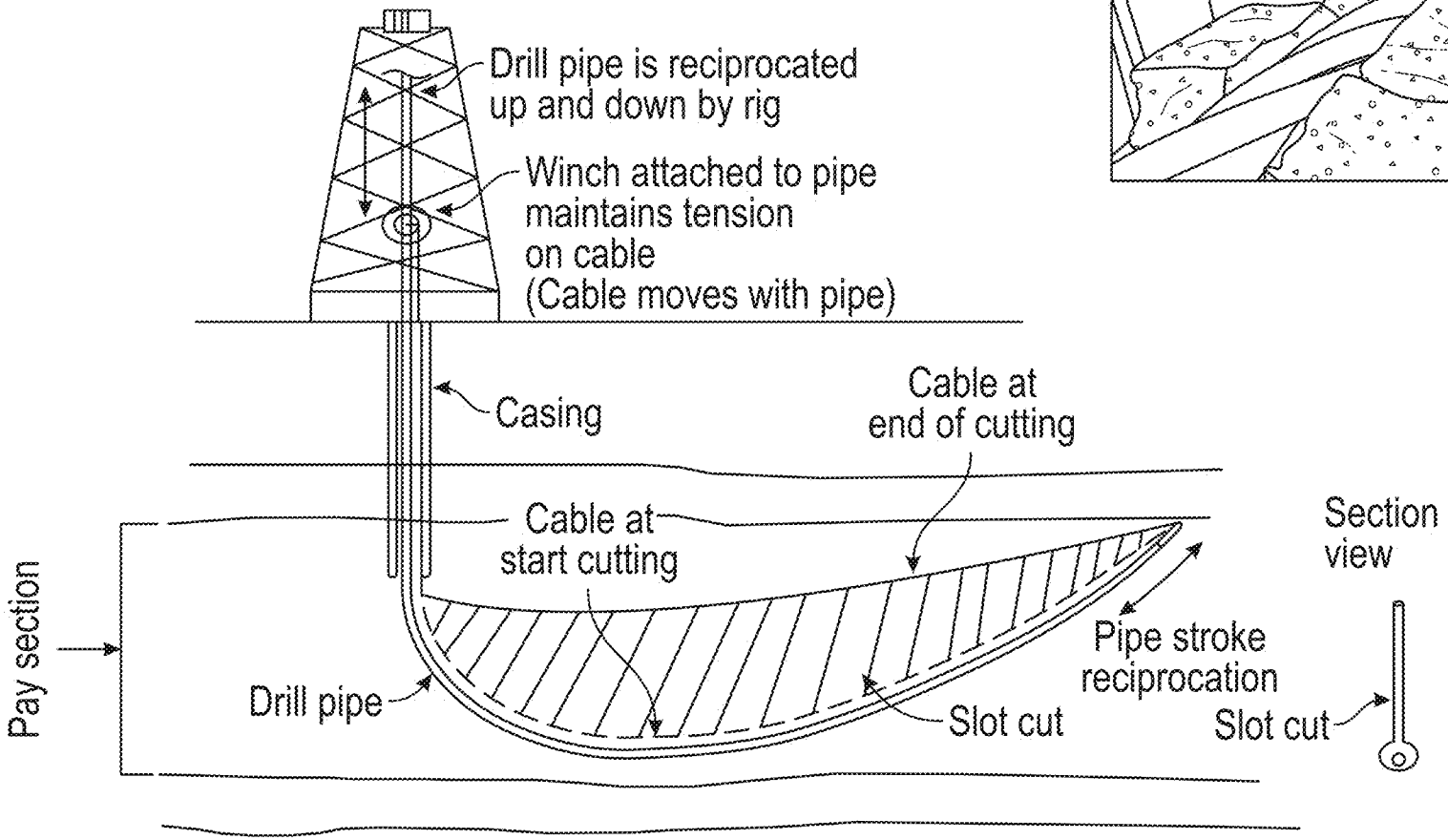

Each slot can comprise a cut in the earth's surface or subsurface having substantially (e.g., +/−50%) uniform surface area. In an aspect, the width of the slot can be about 1 centimeter to 1 meter. The width of the slot is typically the width of the mechanism used to form the slot. In some embodiments, the slots can be cut using slot-drill technology as shown in FIG. 2. In this embodiment, the width of the slot is about the width of the string (e.g., centimeters) used in the slot-drill technology.

Figure 3A:
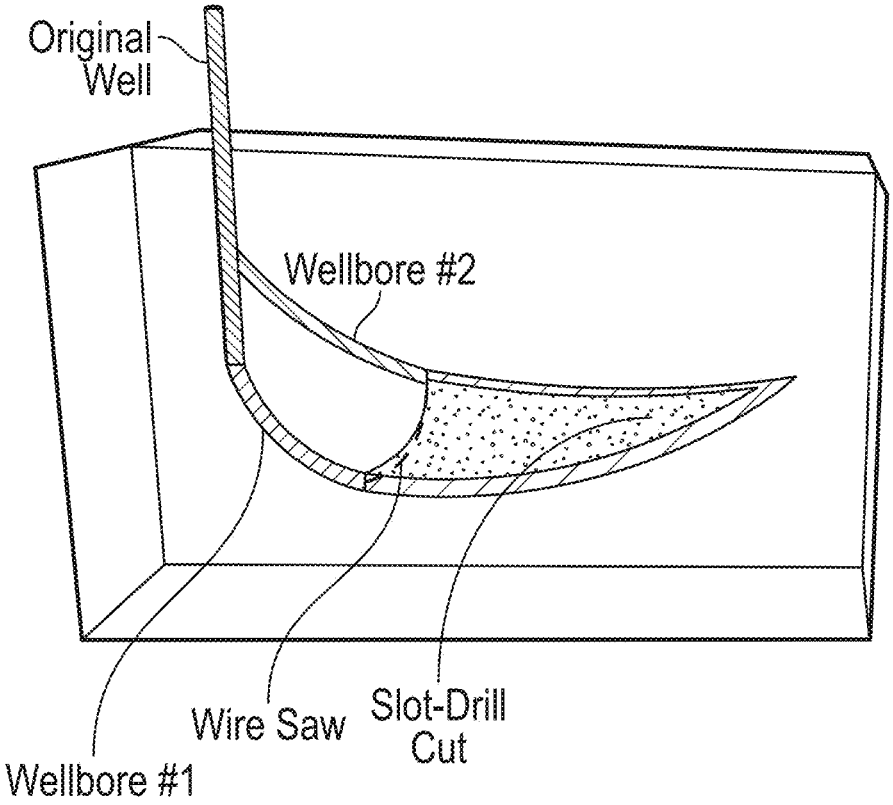
FIG. 3(*a*) shows an example of one method to drill slots using two laterals according to various embodiments of the present disclosure.
Figure 3B:
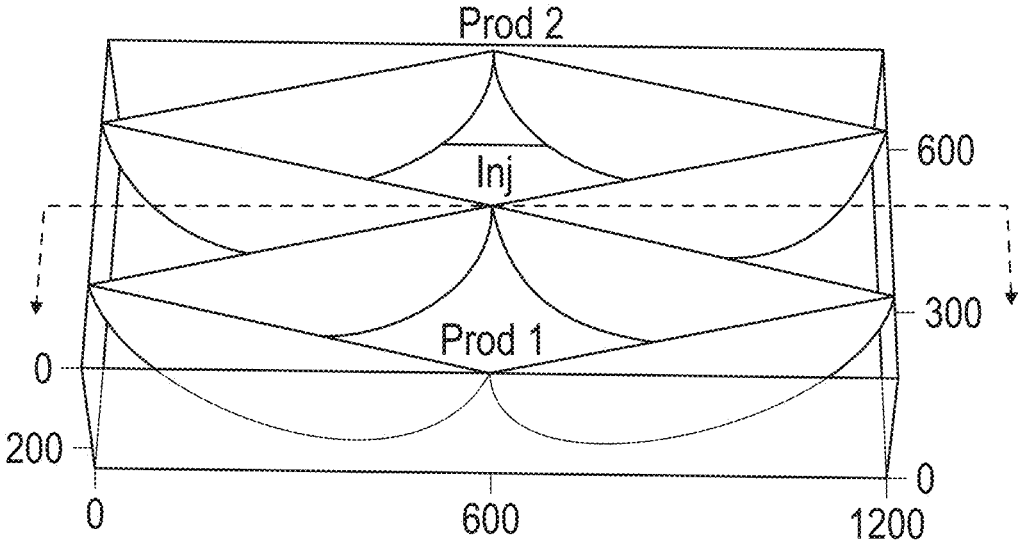

In some embodiments, the slots can be cut in a repeating pattern such as the examples shown in FIGS. 1, 3(*b*), 4, 5(*a*), 5(*b*), 6(*a*), 6(*b*), and 7(*a*) as well as other patterns. In some embodiments, the slots can be cut in alternating directions to form a pattern. The pattern can be configured to optimize coverage of the area between the injection well bore and the production well bore.

In some embodiments, the slots can be cut to intercept naturally occurring fractures in the rock. The naturally occurring fractures can be targeted and used to connect some or all of the slots.

In general, water can be injected via the injection well bore and flow from the injection well bore into the plurality of slots and through the slots to the production well bore where it can be extracted. While flowing through the slots, the water can be heated by the surrounding rock and earth. Then the heated water can be flowed out of the production well bore and the thermal energy used accordingly.

More specifically, the present disclosure provides for a system that includes an injection well bore configured to receive a stream of water. The stream of water is flowed through at least a first slot, where the first slot is at an angle with respect to the injection well bore. In some embodiments, the first slot is substantially perpendicular to the injection well bore. The first slot has a first end and a distal end on opposite sides of the first slot. The first end of the first slot being connected to the injection well bore such that the stream of water flows from the injection well bore into the first slot. The system can optionally include a second slot at an angle to the injection well bore. In some embodiments, the second slot is substantially perpendicular to the injection well bore. The second slot can have a first end and a distal end at opposite ends of the second slot. Optionally, the first end of the second slot is connected to the distal end of the first slot such that the stream of water flows from the first slot into the second slot. The system also includes at least one production well bore. The production well bore is connected to the distal end of the second slot such that the stream of water flows from the second slot into the production well bore. Additional slots can be included in series and/or in parallel the injection well, the first slot, the second slot, and the production well bore. Other aspects are provided for in the examples.

EXAMPLES

Now having described the embodiments of the disclosure, in general, the examples describe some additional embodiments. While embodiments of the present disclosure are described in connection with the example and the corresponding text and figures, there is no intent to limit embodiments of the disclosure to these descriptions. On the contrary, the intent is to cover all alternatives, modifications, and equivalents included within the spirit and scope of embodiments of the present disclosure.

Example 1

This example seeks to demonstrate a technique to cut fractures mechanically and recover heat efficiently from all parts of hot rocks in the subsurface. Although the technique of cutting rocks using abrasive cables in tension has been proposed and used to cut rock slabs at the surface for years, its feasibility in subsurface conditions is yet to be assessed in the field. Unlike hydraulic fracturing, which is typically used for developing tight rocks, this technique of mechanically cutting fractures (referred to as slot-drilling) offers precise control over the fractures' location, size, orientation, and conductivity. This control of fracture location can be used to design and simulate a configuration of slot-drill fractures that could improve the recovery from tight/shale oil reservoirs by a factor of three. In some cases, there is potential of increasing the thermal recovery from EGS by a factor of two if slot-drill fractures are used instead of hydraulic fracturing.

Although FIG. 3(*a*) presents the approach of cutting slot-drill fractures using two laterals, this example will use a one-well configuration. It involves drilling a U-shaped deviated well and cutting the rock by the back-and-forth action of the tensioned abrasive string (like a chain saw). In addition to providing a small-scale proof-of-concept for the slot drilling technique, the rock slab can be heated to temperatures over 100° C. Four small-scale slot-drill fractures will be made in the granite slab, as shown in the region below the dotted red in FIG. 3(*b*). Cold water will be injected at the point marked "inj" while hot water will be produced at "prod_1". The idea is to validate the simulated higher heat recovery from the slot-drill technology using only a fraction of one of the slot-drill fracture configurations.

To obtain results that will inform how to perform slot drilling in the subsurface, an estimation of the strength of the tensioned cable needed to cut the granitic rock outcrop can be performed. This can be compared with the measured force required to create slot-drill fractures in this small-scale field test demonstration. In addition to the measurements of the torque needed to create the small-scale slot-drill fractures, several temperature and pressure sensors will be inserted at several points in the granite slab. These measurements will be used to calibrate the numerical models and provide recommendations on how to perform slot drilling safely and efficiently in the subsurface. Additionally, the thermal energy measurements from this small-scale field test will help validate and calibrate the numerical models. This is important to ensure that the simulated higher thermal recovery efficiency represents what to expect in reality.

This example is to improve the technology-readiness level of the proposed technology to a point where it can be implemented in the subsurface. The specific tasks performed during this project include:

1. Field demonstration of slot drilling at a reduced scale to obtain insights for subsurface implementation.
2. Calibration and validation of the simulations showing high thermal efficiency for the proposed slot-drill EGS (using data from the proposed test).

The main impact of the project will be a demonstration of an alternative approach to create fractures, which, unlike hydraulic fracturing, allows precise control over the placement of fractures in a configuration that ensures the efficient recovery of heat from all parts of subsurface hot rocks. The control over the fracture location, size, and orientation will help avoid the risks associated with the uncertainty in hydraulic fracture location. These include the risk of short-circuiting flow and the risk of the injection or production well not intersecting the fractures created from the first horizontal well drilled. This technology could also be designed for use with existing hydraulically fractured EGS to recover heat from parts of the reservoir that have not been stimulated due to the geomechanical and hydraulic properties of the rocks.

A potential risk is the possibility of the slot-drill fractures closing after being cut. However, the roughness of the fracture surface will prevent it from closing completely and the simulations indicate thermal recoveries even at low to moderate fracture conductivity values. These slot-drilled fractures can also be propped as in hydraulic fractures.

Example 2

This technological invention proposes to improve the efficiency of heat recovery from enhanced (or engineered) geothermal systems (EGS) by using fractures that are mechanically cut into hot dry rocks using the slot-drill technology, which is illustrated in FIG. 2. The slot-drill technology involves cutting a fracture using the abrasive action of a tensioned cable on the formation. Although it has been demonstrated that the slot-drill technology was not promising for primary recovery from shale-oil/gas reservoirs, the proposed technology takes advantage of its ability to create high-conductivity fractures of the same aperture. The technology proposed here involves drilling several slot-drill fractures that intersect one another as shown in FIG. 1. Cold water is injected at one end of the fracture system, gets heated as the water travels through the intersecting slot-drilled fractures, and is produced at higher temperatures from the producing well. The regular and controllable pattern of the intersecting slot-drilled fractures will ensure an even and efficient recovery of heat from all parts of ultra-low permeability geothermal reservoirs. Numerical simulations indicate the potential of this technology, which unlike the alternative approach (based on hydraulic fracturing), allows control over the hydraulic properties of the fractures and allows the precise placement and optimization of the orientation of the fractures.

The reasons why this technology could be the game changer for EGS in ultra-low permeability rocks include:

1. The precise control and certainty of the fracture location gives the flexibility needed to design an efficient subsurface heat exchanger that recovers heat from all parts of the reservoir.

2. This predictability will allow the optimization of the heat extraction process with a drastic reduction in the level of uncertainty, when compared with the use of hydraulic fractures in EGS. The uncertainty in fracture location and hydraulic conductivity in hydraulic fracturing typically results in uneven and uncontrolled recovery which prevents the recovery of heat from certain parts of the hot dry rock.
3. The flexibility to cut these slot-drill fractures in any direction will facilitate the design of an optimum configuration of slot-drill fractures. Conversely, in hydraulic fractures, the fractures typically open against the minimum horizontal stress (in normal and strike-slip faulting regimes). So, it is virtually impossible to create the configuration shown in FIG. 2 with hydraulic fracturing.
4. The use of the proposed technology will yield fractures of known surface areas and approximately same high conductivity. This will allow an efficient and even recovery of heat from all parts of the reservoir and reduce the uncertainty in the optimization of the proposed configuration of the slot-drilled fractures.
5. The ability to cut these slot-drill fractures in any reservoir, regardless of brittleness/ductility makes this technology applicable in geothermal reservoirs that may not brittle.

At this point, only numerical simulation studies have been performed to evaluate the amount of recovery to expect from this technology, and the results appear promising. Current work involves incorporating stochastically generated natural fractures (with different lengths, aperture, conductivity, and orientation) into the matrix, and evaluating the robustness of this technology in such scenarios.

FIG. 1 is an illustration of a connection of several slot-drilled fractures to ensure efficient heat recovery from all parts of an enhanced geothermal reservoir. FIG. 2 is an illustration of the slot-drill completion with an insert that shows how the tensioned cable cuts through the formation.

Example 3

1. Introduction

Enhanced geothermal systems (EGS) are typically tight and naturally fractured like unconventional oil and gas (UOG) reservoirs, so the leading technology being evaluated for their commercial development is also multistage fractured horizontal wells (MFHW). The state-of-the-art approach of thermal recovery from EGS involves injecting cold water into a multiply fractured horizontal/deviated well and producing hot water from a parallel well above the injector. The limited control over the hydraulic fracture location, size, and orientation in MFHWs results in low and unpredictable thermal recoveries. To this end, an alternative technology is presented herein that employs unique configurations of mechanically cut fractures to recover heat efficiently from all parts of hot rocks in the subsurface. The precise control over these fractures' location, size, orientation, and conductivity facilitates the design of suitable configurations of intersecting fractures.

This work presents high-resolution numerical studies of thermal recovery from both MFHW and the proposed approach. The results show that the proposed approach can recover significantly more thermal energy than MFHWs. Additionally, the temperature profiles show that precise control over the location of the fractures allows the reliable and efficient recovery of heat from all parts of the EGS, which could be the key to their commercial development.

Figure 8:
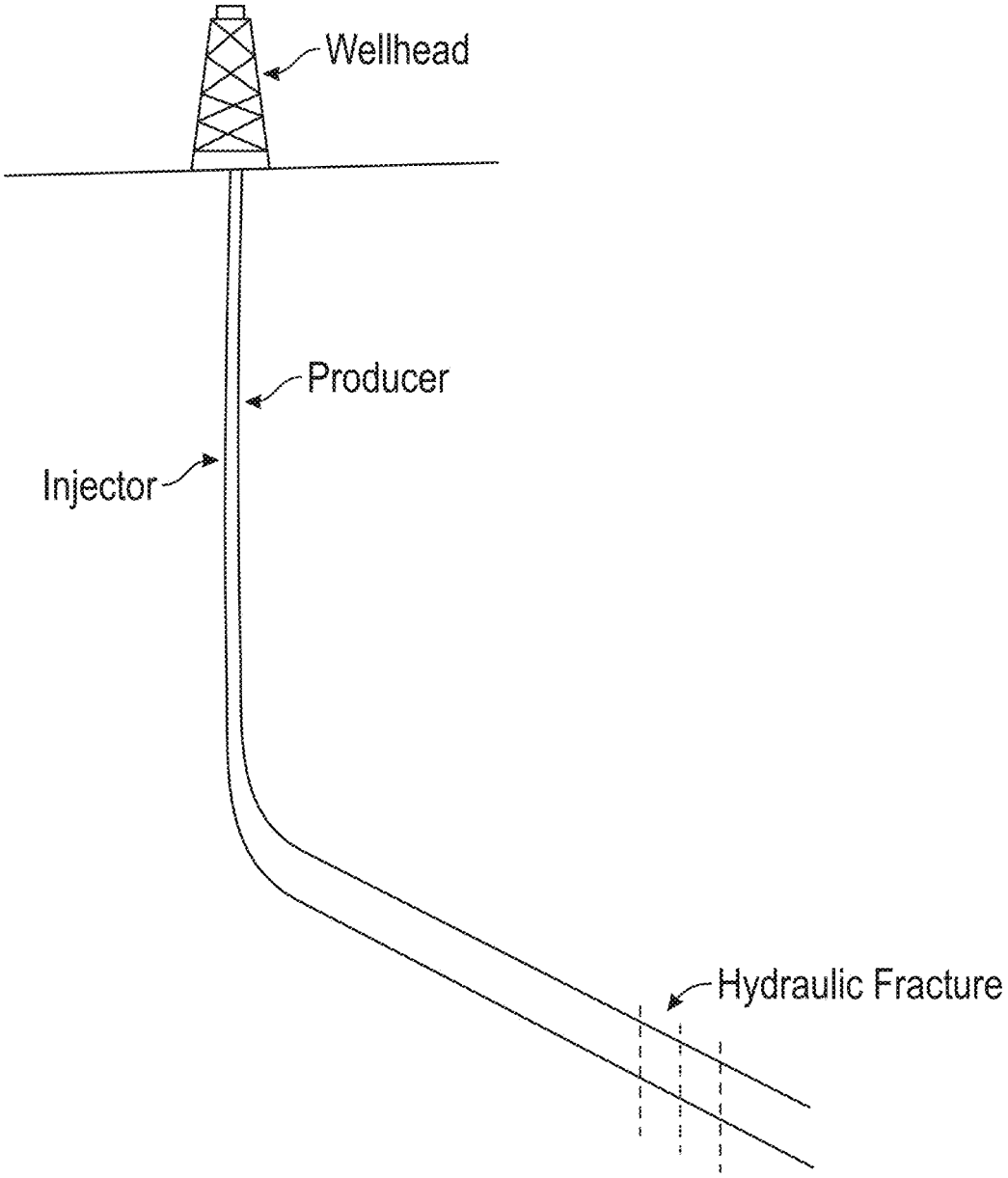
FIG. 8. is an illustration of heat extraction from EGS using MFHW according to various embodiments of the present disclosure.

Enhanced or engineered geothermal systems (EGS) are subsurface heat exchange systems created by fracturing low-matrix permeability hot rocks. The idea is to extract thermal energy economically by circulating cold water through these typically fractured rocks and producing the water after it has been heated via contact with the hot rock in a so-called closed loop. Although early research on EGS development focused on the hydraulic fracturing of vertical wells, several researchers have evaluated the idea of shearing existing joints or natural fractures in these hot rocks. Unfortunately, these approaches have yet to prove commercially viable. The sketch in FIG. 8 illustrates how the multistage hydraulic fracturing technology is applied to EGS. The process (as implemented in the Utah FORGE) involves first drilling a horizontal injection well, and hydraulically fracturing it in multiple stages by pumping slick water at pressures above the least principal stress of the formation. A horizontal production well is then drilled vertically above the fractured injection well to intersect all 3 hydraulic fractures, as shown in FIG. 8. Cold water is then injected continuously into the hot rock through the injection well, while the heated water is produced from the production well. Various authors indicate that a reasonable investment in research and development of EGS in the USA could provide over 100 electric Gigawatts (at a competitive cost) in the next 50 years. The global market for EGS is estimated to be worth $1.8 billion and $3.7 billion in 2020 and 2030, respectively. This has fueled a surge in DOE funding for geothermal resources in the last couple of years, and the trend is expected to continue. One such funded geothermal research project is the Utah FORGE project (https://utahforge.com), which is currently evaluating the first commercial development of EGS with multistage fractured horizontal wells (MFHW). The idea of using MFHW is based on its success in the commercial development of UOG reservoirs, which are also low-permeability matrix systems.

Considering the high costs of evaluating different EGS technologies in the field, several researchers have developed coupled heat and fluid flow simulators to simulate the performance of these technologies. Several researchers have designed computer experiments and sensitivity studies using these simulators to evaluate the potential of MFHW in EGS. For instance, some have performed numerical simulation studies that showed that horizontal wells have higher efficiency than vertical hydraulically fractured wells, which indicates the possible success of MFHW in EGS.

Although virtually all published numerical studies of the application of MFHW in EGS assume that the horizontal injection and production wells intersect all the hydraulic fractures, which are planar and bi-wing, this is only an unrealistic idealization. The negligible control over the size and orientation of hydraulic fractures, as well as the non-planarity and non-orthogonality of these fractures, will result in a lower heat recovery in the field compared to the simulated recovery. The expected lower recovery from non-planar and non-orthogonal fractures (compared to planar and orthogonal fractures) is demonstrated in an analogous system for the primary production from unconventional gas reservoirs. These uncertainties in MFHW highlight the need for a controlled fracture system that can be used to recover heat reliably and efficiently from all parts of an EGS.

EGS are typically naturally fractured and have low matrix permeability like UOG reservoirs, so the fractures generally are modeled using similar methods. The effective models represent the fractured reservoir as an effective medium with homogenized or average properties. For example, researchers have homogenized the naturally fractured system into a single-porosity system to simulate an EGS. Other multiple continuum formulations of the effective medium include the dual-porosity, dual-permeability, and multi-continuum models.

Unlike the effective medium models, discrete models individually account for each fracture in fractured reservoirs. These include the discrete fracture model (DFM), embedded discrete fracture model (EDFM) and projection-based embedded discrete fracture model (pEDFM). Although pEDFM was developed to model natural fractures of high and low conductivity, it cannot accurately model low-conductivity fractures that neither lie parallel to any of the spatial (x-, y-, and z-) axes nor cut through the diagonals of the matrix cells. To obtain reference solutions for the EGS systems studied, the fully dimensional (or explicit fracture) model was used, where each natural fracture is meshed in 3D and partitioned into several fracture cells. Although this approach is very computationally expensive, it is the most accurate approach to model fractured reservoirs. The idea is to obtain high-resolution reference solutions, which can be used to validate the application of other fracture models.

The next section presents the proposed approach to recover heat from EGS using controlled fractures, which are mechanically cut into the rock with the slot-drilling technology proposed.

2. Proposed Slot-Drill EGS

This section presents the design of slot-drill fracture configurations that can lead to improved, reliable, and efficient heat recovery from all parts of an EGS. The slot-drill (SD) technology is based on ideas involving using a chain cutter that is pulled through massive rock outcrops. The EGS approach proposed here involves designing an interconnected system of fractures, which are mechanically cut using the SD technology. The proposed application of this concept to cut fractures in the subsurface involves using a deviated well bore, as shown in FIG. 2.

Figure 4:
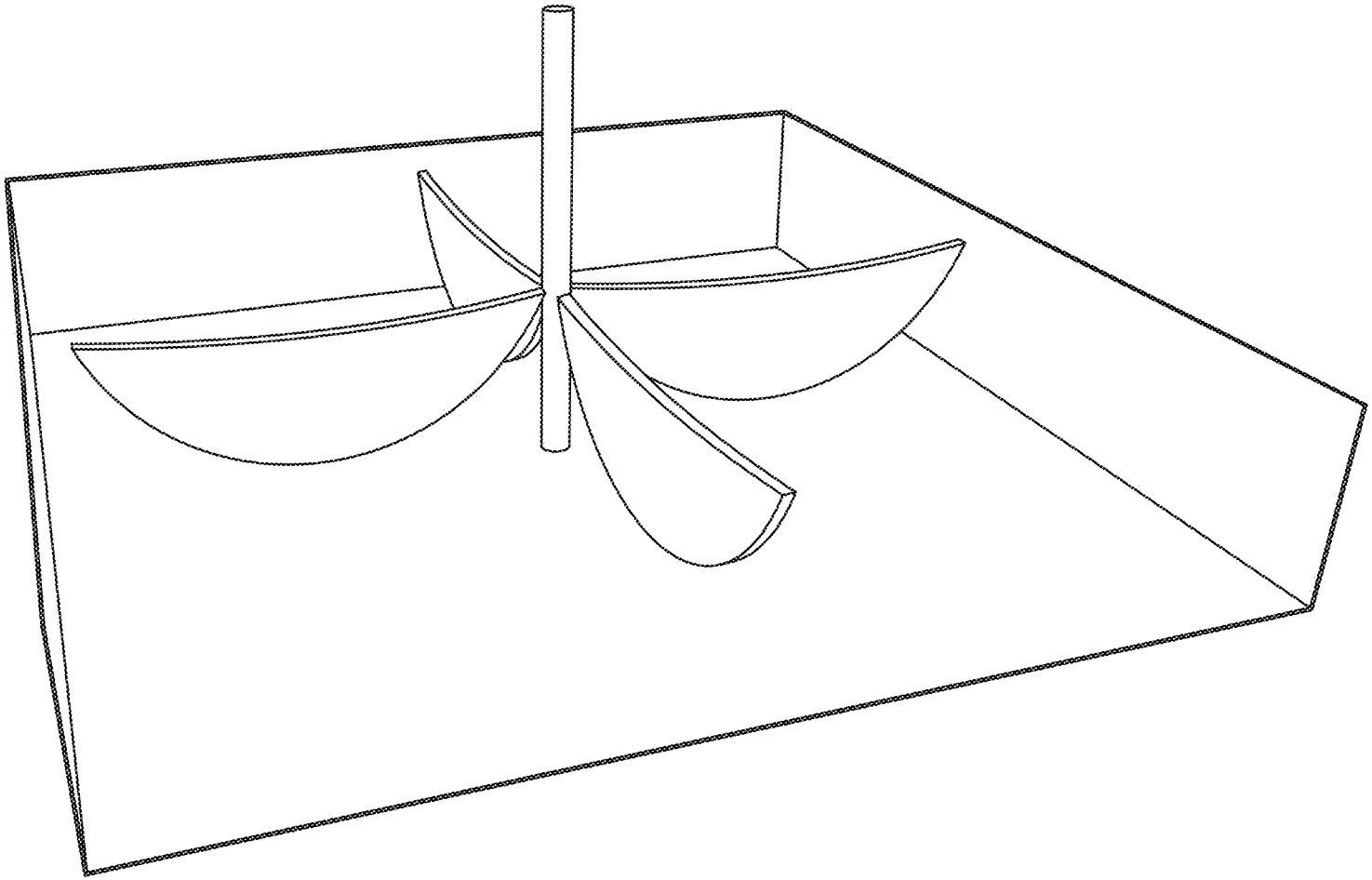
FIG. 4 shows an example of one arrangement of a plurality of interconnected slots according to various embodiments of the present disclosure.
Figure 5B:
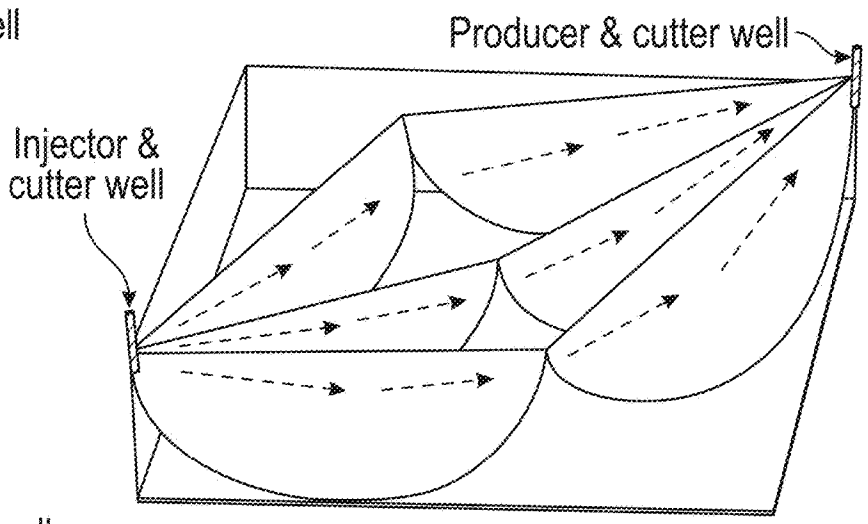
FIGS. 5(*a*)-(*c*) show examples of possible arrangements of a plurality of interconnected slots according to various embodiments of the present disclosure.
Figure 5A:
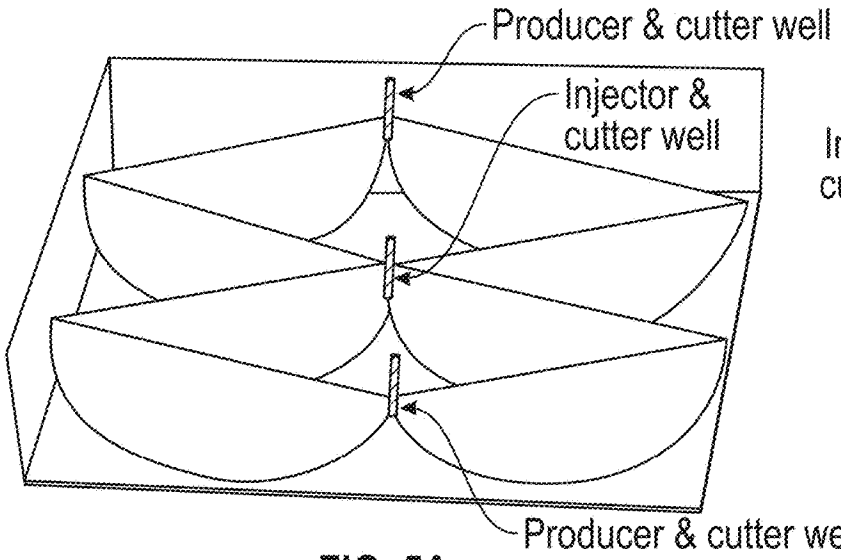
Figure 5C:
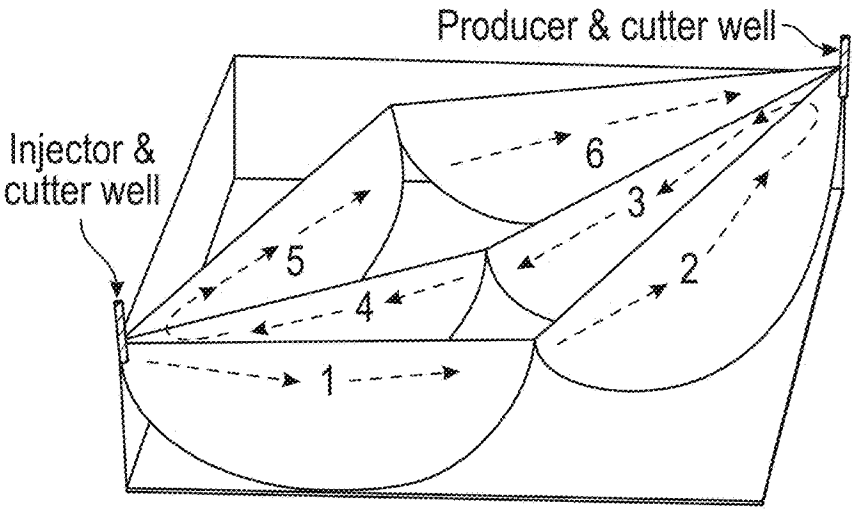

A flexible and tensioned cutting cable (shown as the curved red lines) is then inserted into the wellbore and fixed at the toe of the wellbore. The back-and-forth motion of the tensioned cable could result in the cutting of the slot-drill fracture, shown as the shaded semi-circle in FIG. 2. Although the sketch shows a somewhat fictitious representation of the slot-drill fracture, there are several modifications of the original slot-drilling technique, which will be a subject of a future publication. The idea is to create a modified and more feasible approach to cut the harder rocks expected in geothermal reservoirs mechanically. However, this disclosure focuses on the simulation of different configurations of these mechanically cut fractures that can lead to more efficient and reliable engineered geothermal systems that can recover evenly from all parts of fractured or unfractured hot rocks in the subsurface. Several researchers have already presented a numerical study of the successful application of slot drill fracture in enhanced oil recovery. This study presents the first numerical evaluation of slot drill fracture into enhanced geothermal systems. Also, the configuration of fractures and the completion technology proposed in the study are noble and efficient. Others have proposed the use of a single well to cut multiple fractures in different directions (azimuths) from a single location, as shown in FIG. 4. This work extends this idea by proposing intersecting slot-drill fractures drilled from different wells, as shown in FIG. 5. As shown in FIG. 5, two different slot-drill fracture (SDF) configurations are proposed, which are referred to as the eight SDF triplet and six SDF doublet configurations, respectively. Although, only eight and six SDFs are shown, the actual implementation in the subsurface will involve repeating the pattern of alternating injector and producer as many times as needed.

2.1. Eight Slot-Drill Fracture (SDF) Triplets

This configuration is so-called because the pattern contains eight slot-drill fractures and three wells, as shown in FIG. 5(*a*). Here, a water injection well (shown in green) is surrounded by two producers (in red). It is easy to observe that each vertical well section (whether for a producer or injector) can be deviated and drilled in four different directions. For example, the four slot-drill fractures that intersect the injector well in the middle of the domain in FIG. 5(*a*) can be created by drilling four different deviated wellbores from the injector.

2.2. Six Slot-Drill-Fracture (SDF) Doublet

This configuration is so-called because the repeating pattern contains six slot-drill fractures and two wells, as shown in FIGS. 5(*b*) and (*c*). FIG. 5(*b*) involves flowing the fluid in parallel, whereas, in FIG. 5 (*c*), the well will be completed such that it only injects water into the outermost (either right-most or left-most) fracture. If the injector is restricted to inject only into the right-most SD fracture (SDF #1), for example, the producer will be restricted to only produce from the left-most fracture (SDF #6). The idea is that the fluid will need to move through the fractures in ascending order from SDF #1 through #6. The connection between specific SD fractures like SDF #2 and #3 can be isolated from the tubing and other SD fractures using packers in the annulus, which is only open in the sector or region where those two fractures intersect the annulus. However, SDF #6 will be the only SD fracture allowed to flow into the tubing.

Figure 6A:
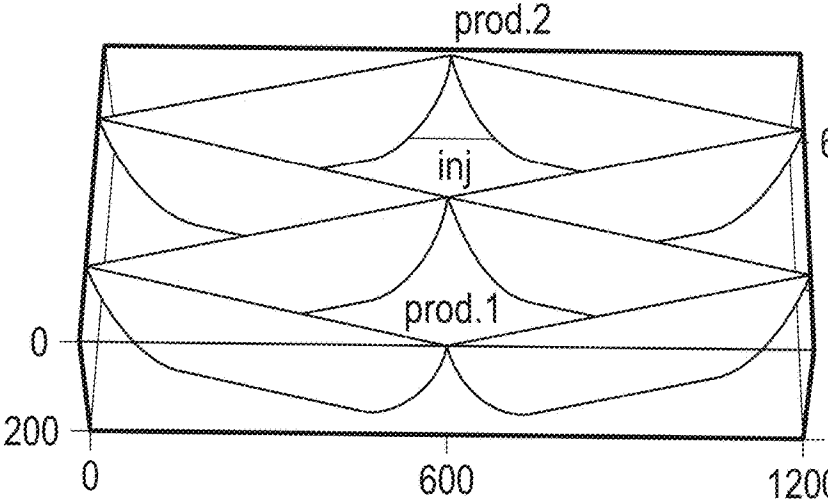
FIGS. 6(*a*)-(*c*) show examples of possible arrangements of a plurality of interconnected slots according to various embodiments of the present disclosure.
Figure 6B:
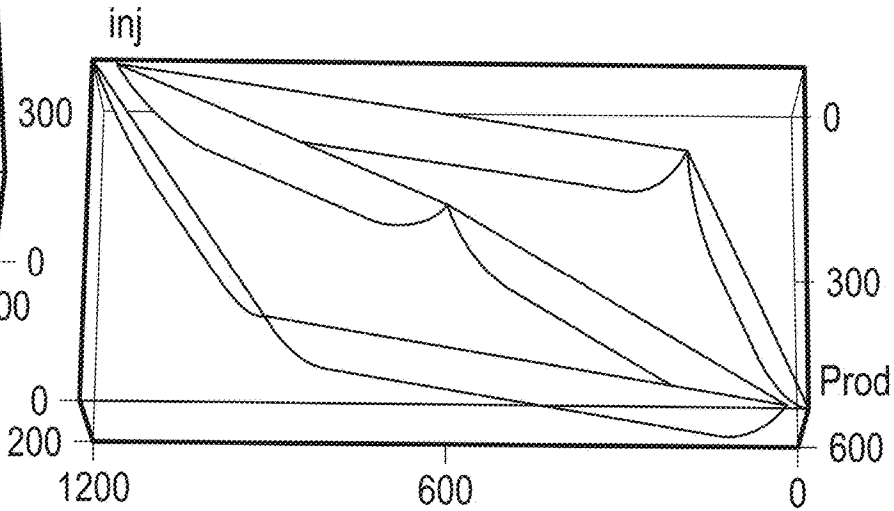
Figure 6C:
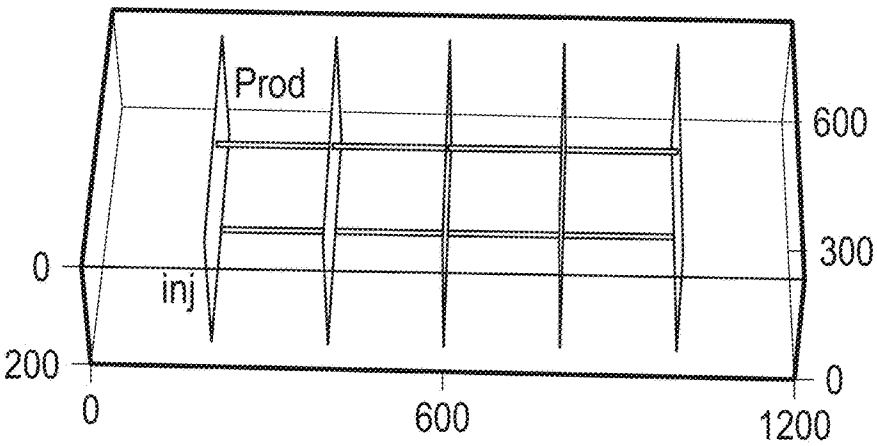
Figure 9A:
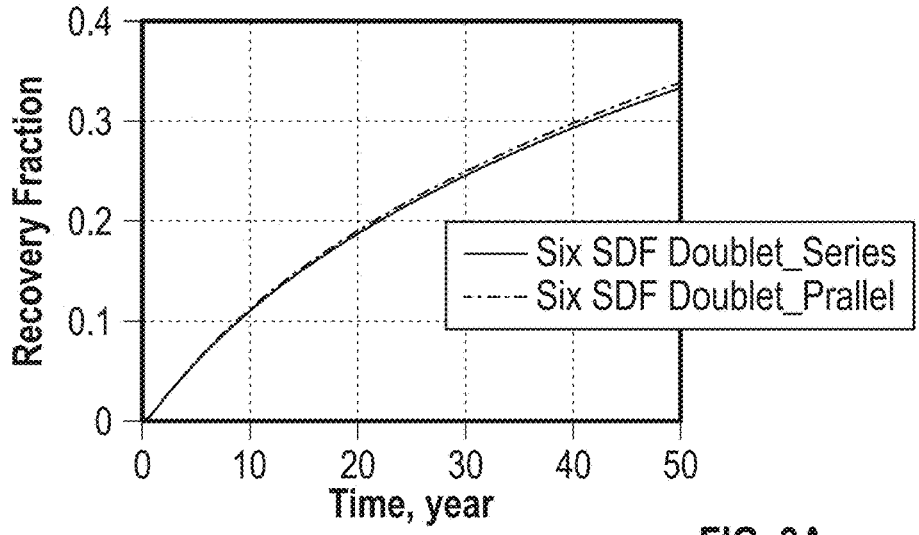
FIGS. 9(*a*)-(*c*) shows a comparison of performance between two configurations of the SDF doublet case according to various embodiments of the present disclosure.
Figure 9B:
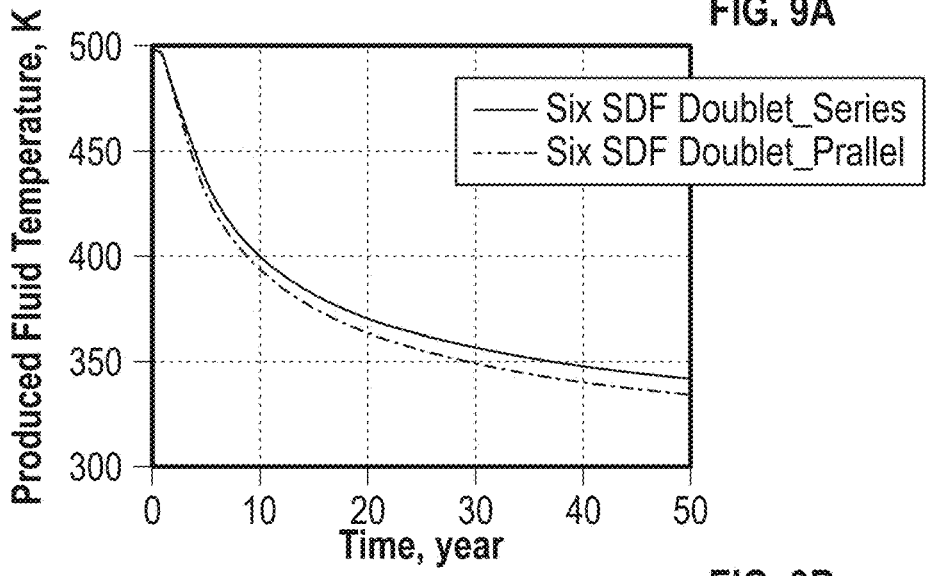
Figure 9C:
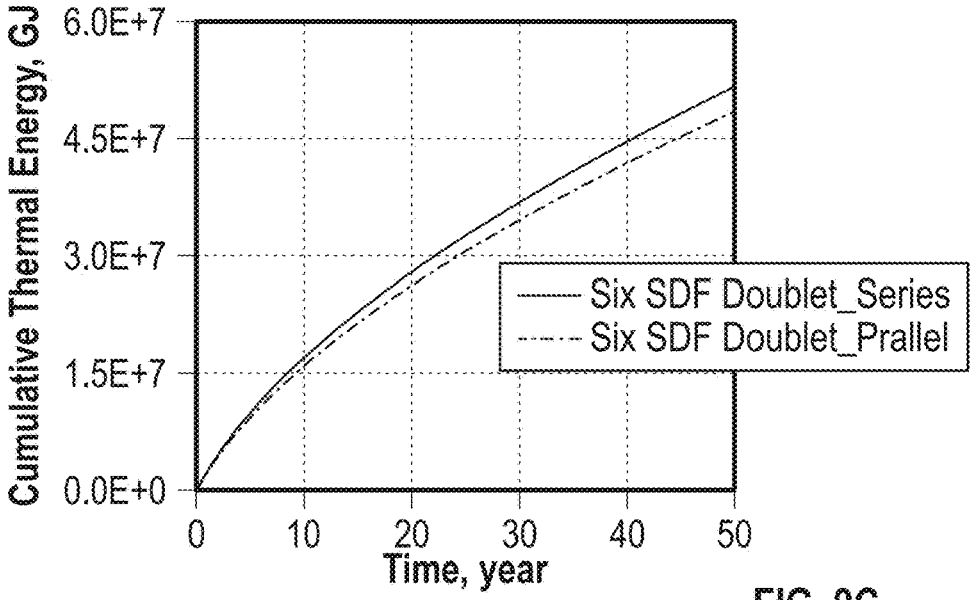

The doublet configuration with parallel flow is referred to as the "doublet parallel" case, whereas the other doublet configuration is referred to as the "doublet series" case. The former was introduced because our numerical simulation studies reveal that although the thermal recoveries of both cases were approximately equal, the latter required unrealistically high injection pressures to flow fluids through the fracture and obtain the same pressure in the production well. Therefore, all subsequent references to the doublet case in this work refer to the doublet parallel configuration. FIGS. 6 and 9 show the comparison of the doublet parallel and series configurations for the 6 and 14 slot-drill fracture cases, respectively.

Compared to the SD triplet configuration, the SD doublet design is more flexible regarding the number of fractures that can be placed in any given area and requires fewer wells per unit SD fracture and per unit area. For instance, it is easy to see that the same vertical injection well section at the bottom corner of the domain can be used to drill the SD fractures in the next pattern below and to the left of the current pattern shown in FIG. 5(*b*). Additionally, to compare this configuration with a multi-stage fractured horizontal well (MFHW) of a much larger total fracture area, Section 5 shows a simulation of a fourteen-SDF doublet configuration.

3. Governing Equations

Modelling the coupled flow of fluid and heat in geothermal reservoirs involves solving the equations that govern both the fluid flow and heat flow. The mass conservation equation for single-phase fluid flow in porous media can be written as follows:

$$\partial t(\phi\rho f) + \nabla\cdot(\rho f\vec{v}f) = (\rho fq)/V, \tag{1}$$

where, $\phi$ is the porosity of the rock, $\rho f$ is the fluid density, vf is the Darcy velocity of the fluid, qf is the source or sink, and V is the bulk volume. From the Darcy equation, the Darcy velocity is given as:

$$\vec{v}f = -\frac{K}{\mu f}(\nabla p - \rho fg\nabla z), \tag{2}$$

where, K is the permeability, $\mu f$ is the fluid viscosity, z is the depth, and g is the acceleration due to gravity.

The energy conservation equation governs the flow of heat in geothermal reservoirs. It is written as follows:

$$\partial t(\phi f\rho fCfT + (1-\phi)\rho rCrT) + \nabla\cdot(\rho fvfhf) + \nabla\cdot(\vec{}Hf + \vec{}Hr) = Qfhf. \tag{3}$$

Here, T is the current temperature of the system, while Cf and Cr are the specific heat capacities of the fluid and rock, respectively. The term Qfhf is the energy source or sink term, and hf is the specific enthalpy, which is given as:

$$hf = Cf\Delta T + \frac{p}{\rho f}. \tag{4}$$

The Hf and Hr terms in equation 3 represent the heat conduction for the fluid and rock, respectively. The equation for heat conduction is given by Fourier's law:

$$\vec{H}f = -\phi\lambda f\nabla T, \tag{5}$$

$$\vec{H}r = -(1-\phi)\lambda r\nabla T, \tag{6}$$

where $\lambda f$ and $\lambda r$ represent the thermal conductivity of the fluid and rock, respectively. Solving the governing mass and energy conservation equations involves discretizing them with respect to time using the implicit or backward Euler scheme. This yields the semi-discrete form of the energy balance equation:

$$\frac{1}{\Delta t}\left([\phi f\rho fCfT + (1-\phi)\rho rCrT]^{n+1} - [\phi f\rho fCfT + (1-\phi)\rho rCrT]^{n}\right) + \nabla\cdot[\rho fvfhf]^{n+1} + \nabla\cdot\left[\vec{H}f + \vec{H}r\right]^{n+1} - [Qfhf]^{n+1} = R^{n+1}_{energy}. \tag{7}$$

Similarly, the semi-discrete form of the mass-conservation equation is given as:

$$\frac{1}{\Delta t}\left([\phi\rho f]^{n+1} - [\phi\rho f]^{n}\right) + \nabla\cdot\left[\rho f\vec{v}f\right]^{n+1} - \left[\frac{\rho fq}{V}\right]^{n+1} = R^{n+1}_{mass}. \tag{8}$$

This work uses the finite-volume discretization with single-point upwind weighting for spatial discretization. The discrete divergence and gradient operators are used to simplify the numerical implementation of the spatial discretization.

These coupled nonlinear equations are linearized using the Newton-Raphson iteration scheme. The linearized system of equations is then solved for the changes in the primary variables ($\Delta X$) at each Newton iteration, using a Bi-Conjugate Gradient Stabilized (BiCG-Stab) linear solver with an Algebraic Multi-Grid (AMG) pre-conditioner. The changes in the primary variables are then added to the previous values of the primary variables (X), and the procedure is repeated until the system converges. Upon convergence, the solution algorithm proceeds to the next time step and repeats this Newton iteration.

To perform the simulation studies presented in this paper, the geothermal and unstructured gridding modules were used in the MATLAB Reservoir Simulation Toolbox (MRST). The stochastic natural fractures simulated were created using the Alghalandis Discrete Fracture Network Engineering code.

3.1. Thermal Recovery Fraction

This work uses the thermal recovery fraction to facilitate a reasonable comparison between the thermal energy recovered from different simulation cases. The equation for the thermal recovery fraction can be given as follows:

$$RF = \frac{Qr}{Qt}, \tag{9}$$

where Qr is the recoverable energy from a geothermal reservoir, which is given as:

$$Qr = \rho_r V_{active} C_r (T_{r,i} - T_{r,a}), \tag{10}$$

and Qt is the total energy stored in the reservoir, which is given as:

$$Qt = \rho_r V_{total} C_r (T_{r,i} - T_o). \tag{11}$$

In these equations, Vactive is the active or effective reservoir volume in $m^3$, Vtotal is the total reservoir volume in $m^3$, $\rho_r$ is the rock density, C, is the specific heat capacity of the rock in J/(kg K), Tr, i is the mean initial reservoir temperature, Tr, a is the mean reservoir temperature at abandonment, and To is the ambient temperature. It is worth noting that equations (10) and (11) implicitly homogenize the entire reservoir and calculate the energy stored from mean reservoir properties. However, in the numerical studies performed in this work, each grid block or cell in the simulation domain has unique temperatures, density, bulk volume, etc. So, the recovery factor is calculated from the summation of the energy stored in each cell at the initial condition and at the end of the simulation. Therefore, the recovery factor (RF) is computed as follows:

$$RF = \frac{\sum_{j=1}^{n_c} \rho_r V_g^j C_r (T_{r,i} - T_r^j)}{\sum_{j=1}^{n_c} \rho_r V_{g,i}^j C_r (T_{r,i} - T_o)} \tag{12}$$

where $V_g^j$ represents the grain volume in cell j at any pressure and temperature (which is the product of the cell volume and one minus the current porosity of the cell), $V_{g,i}^{j}$ is the initial value of the grain volume in cell j, and $T_r^j$ is the current temperature in cell j. The superscript $n_c$ in the summation indicates that the equation is evaluated and summed over the total number of cells ($n_c$) in the simulation domain.

3.2. Thermal Energy

Estimating the thermal energy of the produced hot water is essential for evaluating the commercial feasibility of an enhanced geothermal system. The "extractable" thermal energy depends on the produced fluid's amount and temperature. To estimate it, we first compute the extractable energy at the wellhead ($E_{wh}$):

$$E_{wh} = m_{wh}(h_{wh} - h_{ref}), \tag{13}$$

where $h_{wh}$ and $h_{ref}$ are the enthalpies of the fluid at the wellhead and reference conditions, respectively. The symbol $m_{wh}$ represents the mass of hot water extracted from the producer. The mass flow rate can be calculated as follows:

$$\dot{m}_{wh} = \rho q. \tag{14}$$

Here, q is the volumetric flow rate at the wellhead in $m^3/s$. Therefore, the cumulative thermal energy ($E_{cum}$) can be estimated by integrating the product of the mass flow rate (14) and ($h_{wh}$–$h_{ref}$) over a time interval (dt) in seconds:

$$E_{cum} = \int \dot{m}_{wh}(h_{wh} - h_{ref})dt. \tag{15}$$

4. Validation Against TOUGH3

Figure 10:
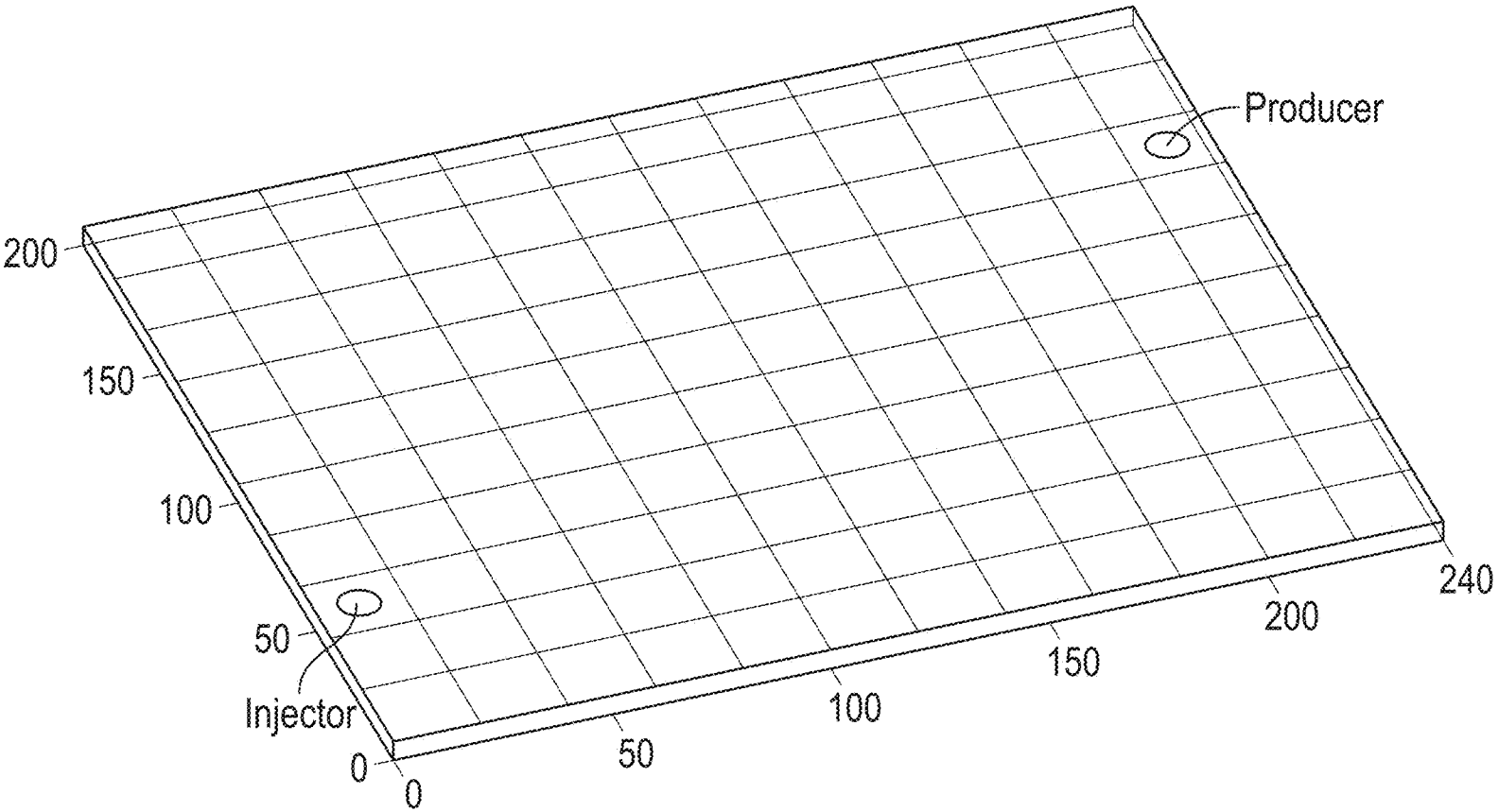
FIG. 10 is a simulation domain for a simple injector and producer well pair in a 2D Cartesian grid according to various embodiments of the present disclosure.

This section verifies the extended MRST codes against the TOUGH3 simulator from the Lawrence Berkeley National Lab. FIG. 10 presents the simulation domain used. The problem involves injecting water at 22° C. close to the bottom left of the domain, while hot water is produced from the well close to the top right of the domain. To ensure that the same mesh is used in TOUGH3 and our modified MRST code, a MATLAB script was written that exports the MRST mesh directly into the TOUGH3 mesh input format. Table 1 summarizes the model parameters for this verification case.

TABLE 1 used for the validation against TOUGH3

| Reservoir parameters | Value | Unit |
|---|---|---|
| Permeability | 200e–12 | $m^2$ |
| Porosity | 0.5 | — |
| Reservoir dimensions | 240 × 200 × 0.04 | m |
| Grid dimensions | 20 × 20 × 0.04 | m |
| Initial reservoir pressure | 98e5 | Pa |
| Initial reservoir temperature | 300 | K |
| Fluid thermal conductivity | 0.6 | W/(m K) |
| Fluid heat capacity | 4200 | J/Kg K |
| Fluid density | 1000 | $Kg/m^3$ |
| Fluid viscosity | 1.0e–3 | Pa-s |
| Rock thermal conductivity | 2650 | W/(m K) |
| Rock heat capacity | 1000 | J/Kg K |
| Rock density | 2650 | $Kg/m^3$ |

TABLE 1-continued used for the validation against TOUGH3

| Reservoir parameters | Value | Unit |
|---|---|---|
| Injection rate | 1e–3 | $m^3/s$ |
| Bottom hole pressure | 96.5e5 | Pa |

Figure 11B:
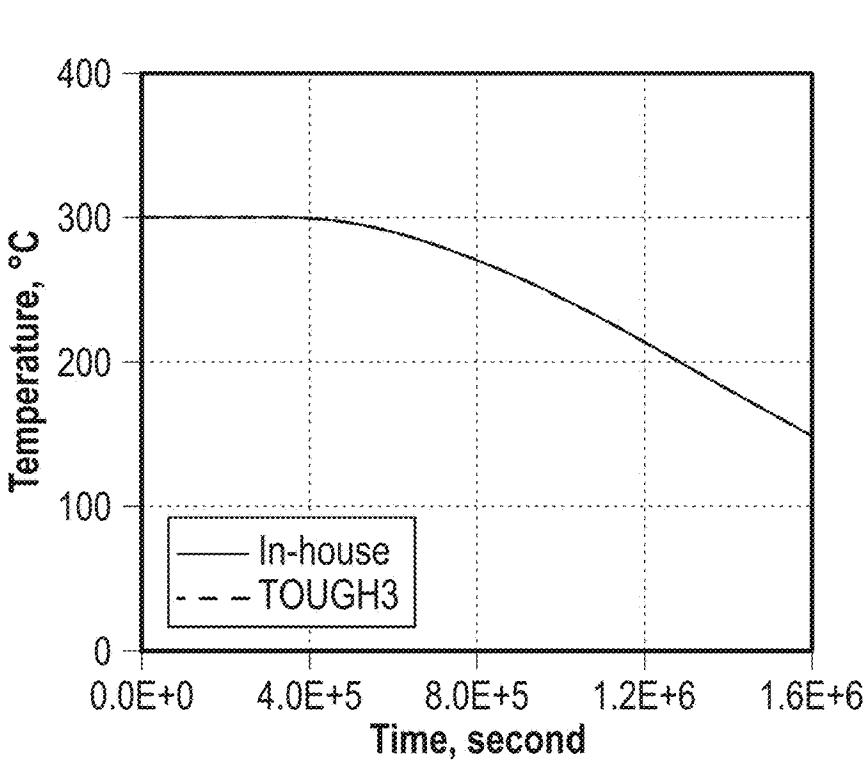
FIG. 11(*a*) is an example of a pressure profile of a production well according to various embodiments of the present disclosure.
Figure 11A:
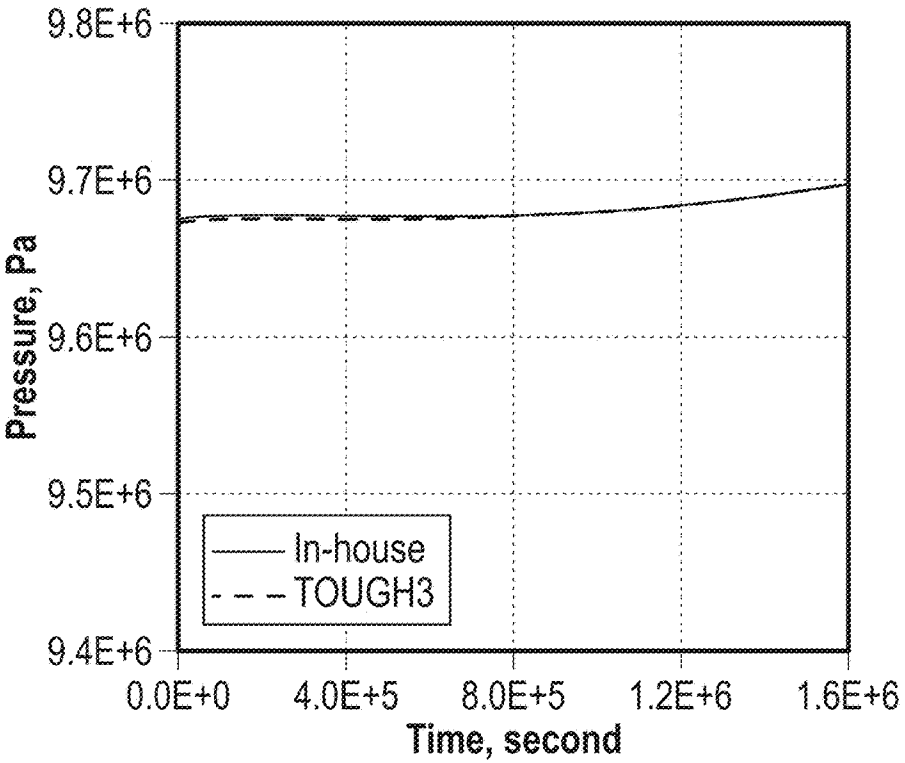

FIG. 11 presents the plot of the producer's pressure and temperature over 18 days. The maximum errors in pressure and temperature are 0.08% and 0.45%, respectively. These results show that our model closely matches the TOUGH3 code over the simulated period of injection and production. The results show that the pressure of the production well increases almost instantaneously to a value of 9.67 MPa, and slowly increases to 9.7 MPa. In contrast, the temperature of the producer gradually declines from the initial temperature of 300° C. to a final value of 153° C.

5. Application of Slot-Drill Fractures in EGS

This section presents the simulation studies of the SDF EGS configurations shown in Section 2. FIG. 6 gives the mesh for the SD EGS triplet (in FIG. 6(*a*)), SD EGS doublet (FIG. 6(*b*)), and an MFHW case (FIG. 6(*c*)) with the same total fracture surface area as the SD EGS cases. The same reservoir dimensions were used in all three cases to reasonably compare the simulated thermal recovery fraction of the proposed SD EGS technologies and the state-of-the-art approach, which uses MFHW. The configuration of the MFHW case is consistent with the proposed approach for the development of the Utah FORGE project, where the bottom horizontal or deviated well is used to inject cold water, and a relatively parallel well above the injector is used to produce the hot water. Table 2 outlines the model parameters used in the simulation of the three cases presented. Although all the simulation results presented used no-flow and fully insulated boundary conditions on the external faces of the simulation domain, using constant-temperature boundary conditions does not change the trends in the results.

Figure 12B:
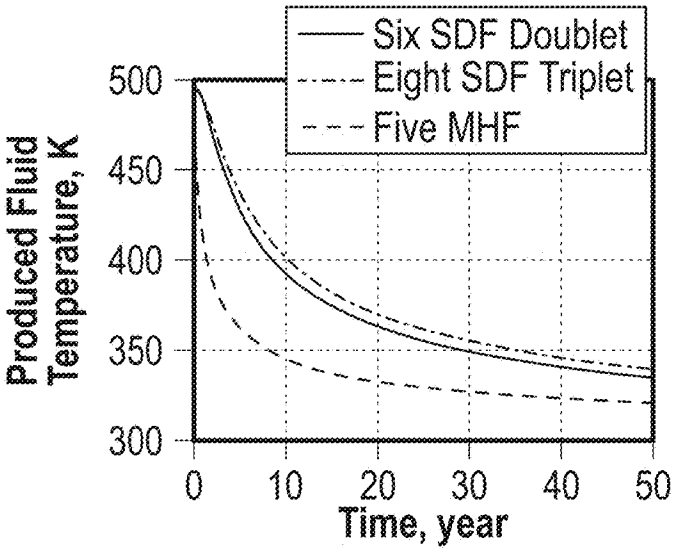
FIG. 12 shows performance plots for coupled hydrothermal simulation of the Triplet with eight SDF, doublet of six SDF, and MFHW EGS cases according to various embodiments of the present disclosure.
Figure 12A:
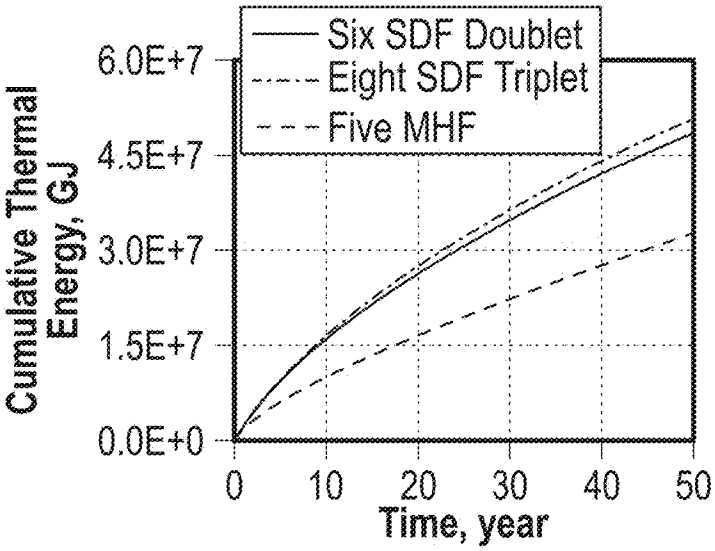
Figure 12C:
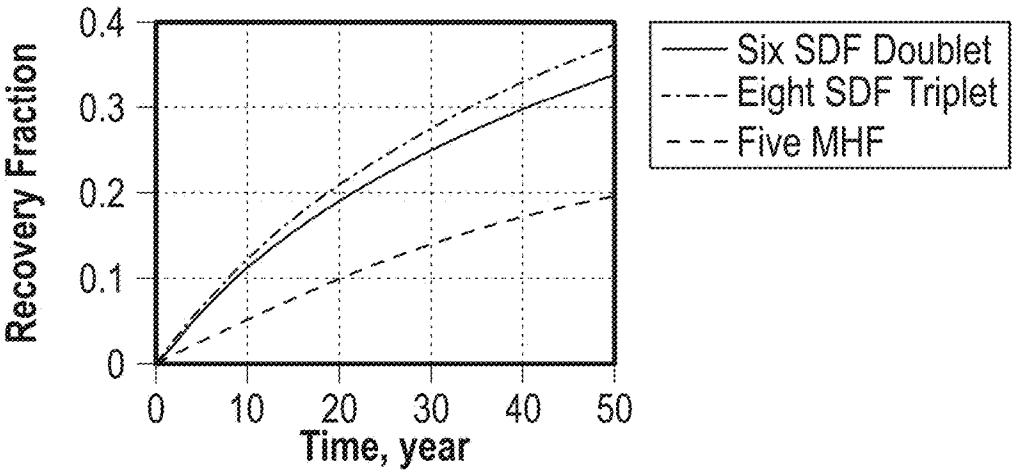

FIG. 12 presents the performance plots for the MFHW and SD EGS cases. These cases are compared in terms of the cumulative thermal energy of the hot water produced (in FIG. 12(*a*)), the temperature of the produced fluid (in FIG. 12(*b*)), and the thermal recovery fraction (in FIG. 12(*c*)). FIG. 12(*a*) shows that the two SDF cases yield higher cumulative thermal energy than the MFHW case. The equations presented in Section 3.2 show that the cumulative thermal energy is a linear function of enthalpy, which is a linear function of the produced temperature. So, the higher cumulative thermal energy of the SDF cases is expected because the same volume of water is injected and produced in all three cases. Still, the temperature of the produced fluid is higher in the SDF cases than in the MFHW case (as shown in FIG. 12(*b*)). The temperature of the produced fluid needs to be above the commercial limit to produce electricity from an EGS. When the 20° C. (or 293.15 K) injected fluid comes in contact with the hot rock, it extracts heat from the rock, increasing the fluid temperature. For a specific amount of fluid, the temperature of the produced fluid will increase with an increase in the contact area and duration of the fluid in the subsurface. FIG. 12(*b*) shows that the produced fluid temperature is highest in the SDF cases. This is expected, considering that the injected fluid travels much longer distances in the SDF cases than in the MFHW case. These longer flow paths result in larger contact areas for the injected fluid and a longer duration that the injected fluid spends in the subsurface before being produced.

FIG. 12(*c*) shows that the simulated thermal recovery fraction of the proposed SDF EGS cases is much higher than that of the MFHW of the same fracture area. The thermal recovery fraction for the eight SDF triplet, six SDF doublet, and the five MFHW cases are 38%, 34%, and 20%, respectively. These results imply that the proposed application of the slot-drill technology to enhanced geothermal systems could yield a thermal recovery that is two times that of the current state-of-the-art technology, which uses multistage fractured horizontal wells.

TABLE 2

Model parameters used in the comparative study of the geothermal potential of the MFHW and SD EGS cases.

| Reservoir parameters | Value | Unit |
|---|---|---|
| Matrix permeability | $9.86e^{-21}$ | $m^2$ |
| Matrix porosity | 0.01 | — |
| Fracture permeability | $9.8692e^{-13}$ | $m^2$ |
| Fracture porosity | 0.5 | — |
| Fracture aperture | 0.05 | m |
| Total fracture volume | $2.75e^6$ | $m^3$ |
| Reservoir dimensions | 1200 × 600 × 250 | m |
| Initial reservoir pressure | $30e^6$ | Pa |
| Initial reservoir temperature | 496 | K |
| Injected fluid temperature | 293 | K |
| Constant injection rate | 0.069 | $m^3/s$ |
| Constant producer bhp | $25e^6$ | Pa |
| Rock thermal properties | | |
| Rock thermal conductivity | 3.0 | W/(m K) |
| Rock density | 2700 | $Kg/m^3$ |
| Heat capacity | 1000 | J/Kg K |
| Fluid properties | | |
| Fluid thermal conductivity | 0.6 | W/(m K) |
| Fluid heat capacity | 4200 | J/Kg K |
| Coefficient of thermal expansion | $207e^{-6}$ | $K^{-1}$ |
| Fluid compressibility | $4.4e^{-10}$ | 1/Pa |
| Fluid density | 1000 | $Kg/m^3$ |
| Fluid viscosity | $0.5e^{-3}$ | Pa-s |

The cumulative thermal energy and produced fluid temperature profiles of the two SDF cases are almost identical, but the thermal recovery fraction of the eight SDF triplet is higher than that for the six SDF doublet configuration. To understand this counterintuitive observation, it is worth noting that both cases produce the same total fluid volume at almost identical temperatures, and the fracture volumes for both cases are approximately the same (within 0.28%). However, the triplet case has two producers, while the doublet case has only one producer. The average temperatures (after 50 years of simulated production) are 427 and 421 K for the doublet and triplet cases, respectively.

Although the temperature of the injection well is approximately the same in the two SDF cases, the production well temperature (shown in FIG. 12(*b*)) is observed at only one point in the reservoir for the doublet case but observed at two points in the triplet case. This production temperature is lower than the initial temperature. So, having the temperature maintained at a low value at two points yields a lower average temperature in the SDF triplet case. Unlike the cumulative thermal energy, the thermal recovery fraction is computed only from the drop in the temperature in the reservoir relative to the initial condition, as shown in equation (12), so the triplet case has a higher thermal recovery fraction. Although this result looks counterintuitive when compared to routine reservoir fluid production, the main difference is that the recovery fraction for fluids is computed from a ratio of fluid volumes and not a ratio of pressures, which are the corresponding primary variables.

A computation of the volume-weighted average temperature for the two SDF cases after 50 years of thermal recovery confirms that the thermal recovery fraction is indeed higher in the eight SDF triplet configuration. This yielded average temperatures of 422 K and 427 K for the eight SDF triplet and six SDF doublet configurations, respectively. The lower value of the eight SDF triplet configuration indicates that more thermal energy has been recovered from the geothermal reservoir. Additionally, this higher recovery fraction is consistent with the fact that the SDF triplet case will incur more drilling and completion costs (involving three wells) than the SDF doublet, which applies only two wells for the same reservoir domain.

To obtain insights into the thermal recovery from the three EGS configurations presented, the temperature profiles (after the simulated 50 years of thermal energy recovery) are presented in FIG. 13. FIG. 13(*a*) shows the temperature profile of an SDF triplet after 10 years. FIG. 13(*b*) shows the temperature profile of an SDF triplet after 30 years. FIG. 13(*c*) shows the temperature profile of an SDF triplet after 50 years. Similarly, FIG. 13(*d*) shows the temperature profile of an SDF doublet after 10 years, FIG. 13(*e*) after 30 years, and FIG. 13(*f*) after 50 years. In FIG. 13(*g*), shown is the temperature profile of an MHF after 10 years, FIG. 13(*h*) after 30 years, and FIG. 13(*i*) after 50 years. The blue-colored region corresponds to the injected fluid temperature of 20° C. or 293.15 K. In contrast, the red-colored region corresponds to the portion of the reservoir that has not been recovered and is at the initial volume-weighted average temperature of 496 K. So, these temperature profiles show that a more significant portion of the reservoir rock is cooled down to the injected fluid temperature in the SDF cases when compared to the MFHW case.

5.1. Extended SDF Doublet

Figure 7A:
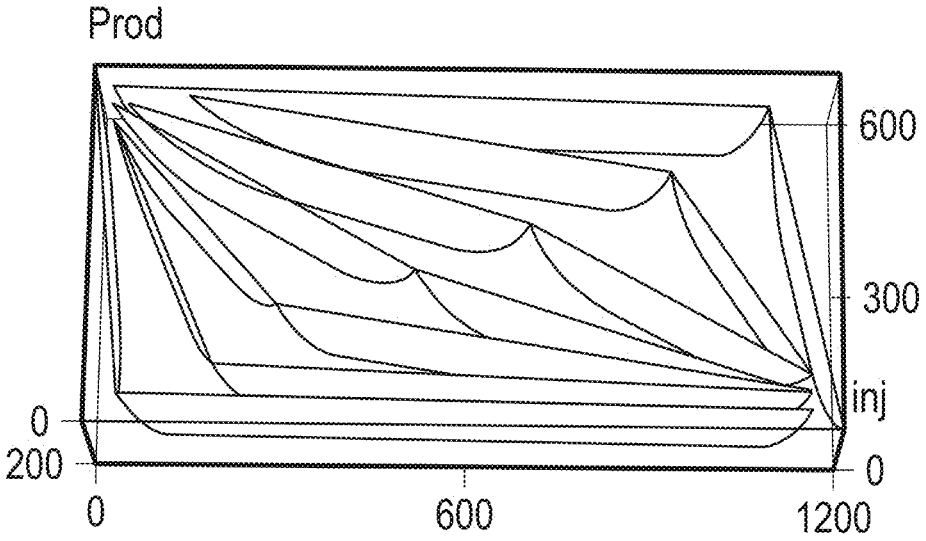
FIGS. 7(*a, b*) show examples of possible arrangements of a plurality of interconnected slots according to various embodiments of the present disclosure.
Figure 7B:
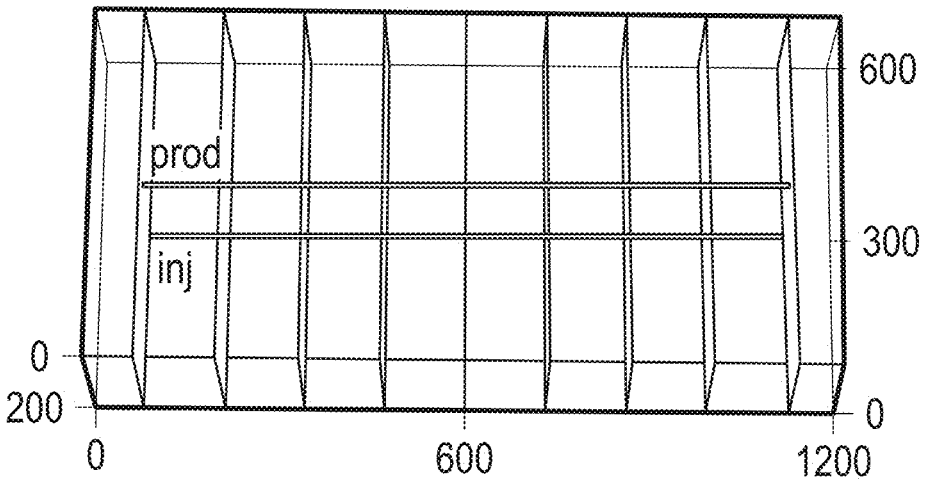

As explained in Section 2.2, the six SDF doublet configuration uses fewer wells per unit SD fracture and provides the flexibility needed to use any number of SD fractures within a given area. In this section, the number of SD fractures (in the same domain presented in the previous section) is increased from six SDFs in the doublet configuration to 14. The idea is to evaluate the corresponding increase in thermal energy recovery as the number of SDF fractures increases. A corresponding MFHW case with the same total fracture area is also provided to facilitate a reasonable comparison with the state-of-the-art approach for thermal recovery from EGS. FIG. 7(*a*) presents the mesh for the 14 SDF doublet EGS configuration, whereas FIG. 7(*b*) presents the mesh for the corresponding multistage fractured horizontal well case.

Figure 14A:
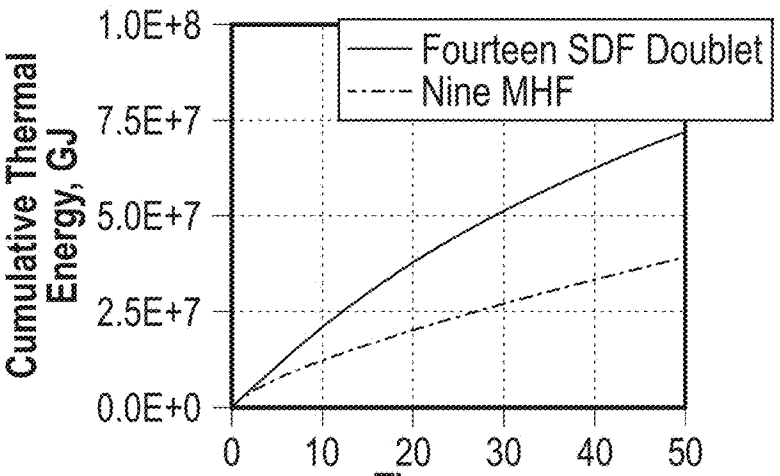
FIG. 14 shows (a) the cumulative thermal energy production, (b) the bottomhole temperature of the producer, and (c) the thermal recovery fraction for the EGS doublet configuration with 14 SD fractures and its corresponding MFHW case according to various embodiments of the present disclosure.
Figure 14B:
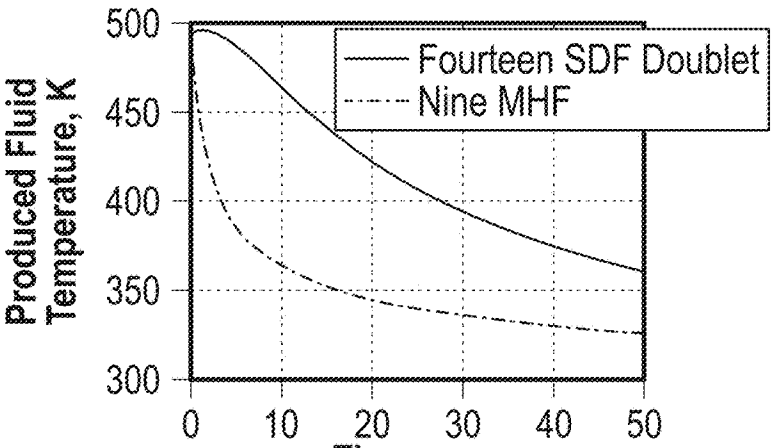
Figure 14C:
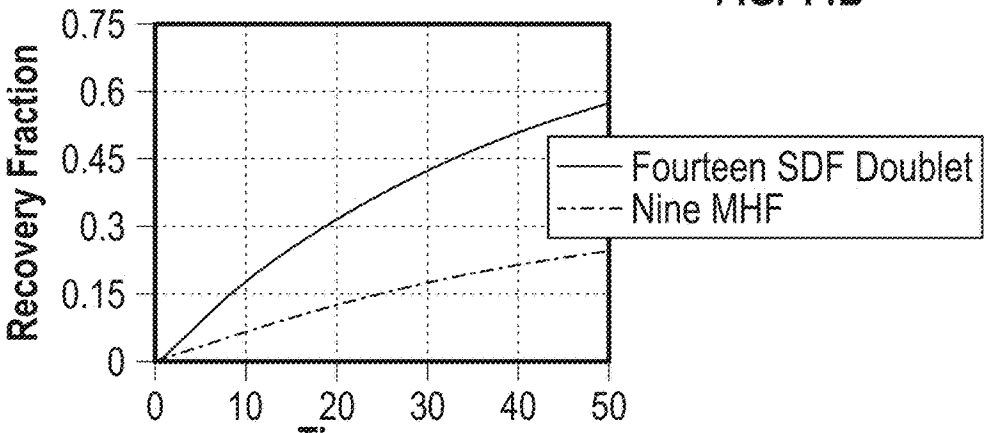

FIG. 14 presents the cumulative thermal energy, produced fluid temperature, and recovery factor for the SDF doublet and MFHW cases. FIG. 14(*a*) shows a comparison of the produced thermal energy for the extended cases. FIG. 14(*b*) shows a comparison of the produced fluid temperature for the extended cases. FIG. 14(*c*) shows a comparison of the thermal recovery fraction for the extended cases. The cumulative thermal energy shows that the SDF case yields more cumulative thermal energy even though the rates of fluid injection and production from both cases are the same. This is because the temperature of the produced fluid is much higher in the SDF case, as shown in FIG. 14(*b*). FIG. 14(*c*) shows that the thermal recovery fraction for the SDF case (57%) is over two times more than in the MFHW case (24%) with the same total fracture surface area. In comparison to the recovery fraction of 34% from the SDF doublet case in FIG. 12(*c*), this SDF case with 14 SD fractures only yields a 68% increase in the recovery fraction even though it uses more than two times the number of SD fractures. This observation underscores the importance of performing numerical simulations to determine the optimum number of SDF fractures to recover a given region of the hot subsurface rock. The flexibility offered by the SDF doublet configurations and the economical analysis of the costs associated with each SDF fracture could be pivotal in the commercial recovery of heat from enhanced geothermal systems. It is worth noting that the produced fluid temperature of the fourteen SDF doublet case is almost constant for three years, unlike that of the MHF case, which declines quickly from the onset of production. This is because the injected fluid volume is partitioned into fourteen, so the fluid flow rate through the fracture is slow and over a much larger distance in comparison to the MHF case. This allows the water to be heated close to the initial (volume-weighted average) temperature of the reservoir during the first three years of production. In contrast, the injected cold water in the Nine MHF case is partitioned into nine, and it only interacts with the hot rock over the small distance from the point where the injection well intersects each fracture to the corresponding point where the production well intersects it. So, the producer temperature decreases rapidly as soon as the heat in the area near the fractures is recovered.

Figure 15B:
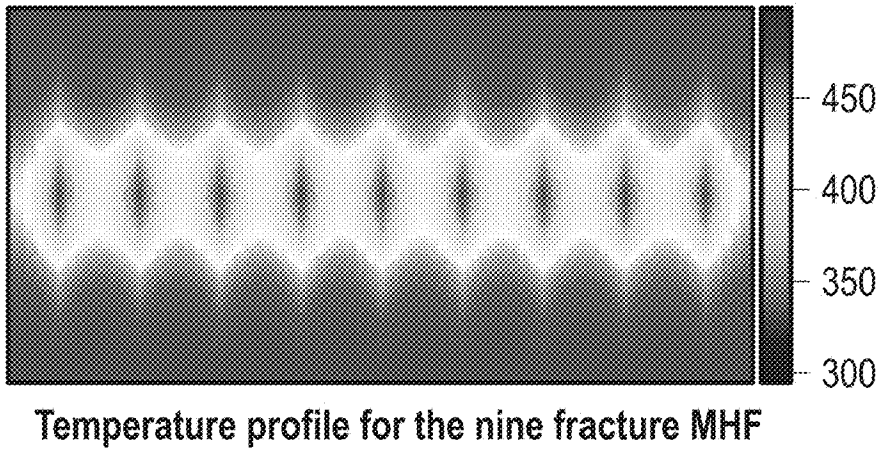
FIGS. 15(*a, b*) are example profiles showing the temperature distribution at the top of the reservoir after simulating the injection and production of water for 50 years according to various embodiments of the present disclosure.
Figure 15A:
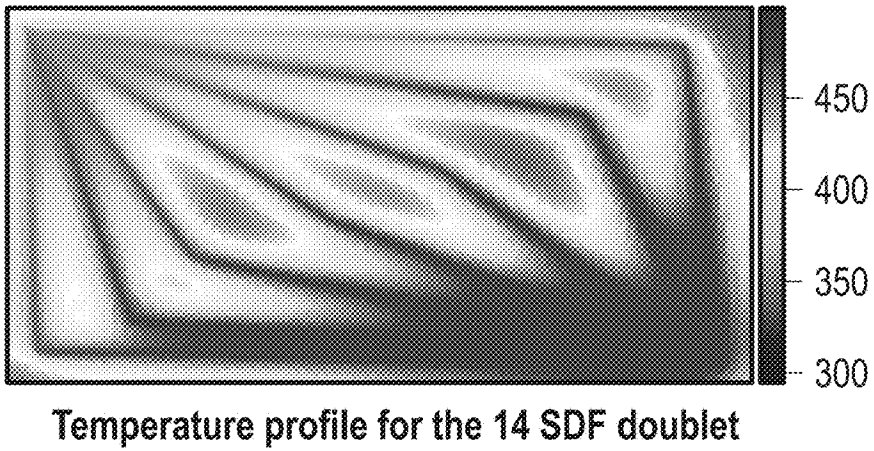

FIG. 15 presents the temperature profile for both the SDF doublet (FIG. 15(*a*)) and MFHW (FIG. 15(*b*)) cases after 50 years of simulated thermal recovery. These profiles again show that the area or volume of the blue-colored region is much more in the SDF case than in the MFHW case. This indicates that more heat has been recovered from the SDF case than from the MFHW case. As mentioned in the introduction, most enhanced geothermal systems are naturally fractured. So, the next section focuses on studying the effect of natural fractures on thermal recovery.

Figure 16A:
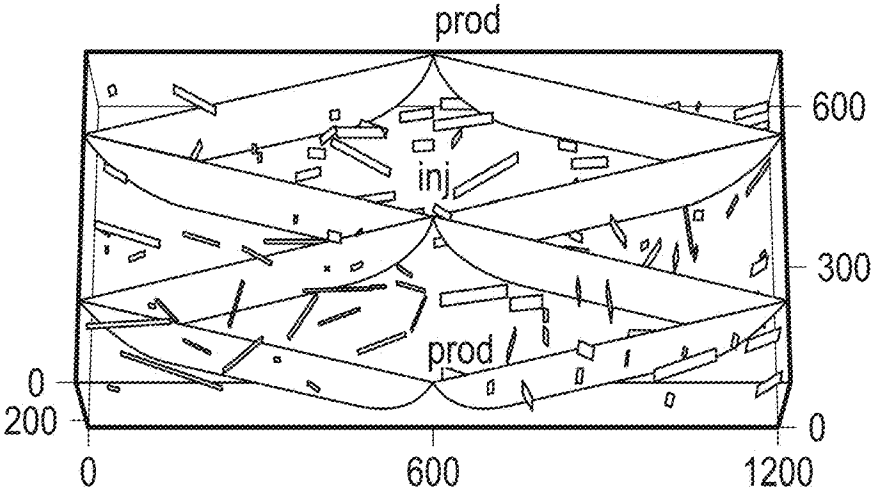
FIGS. 16(*a, b*) show the plot for a naturally fractured reservoir with 160 stochastic natural fractures. The same fractured domain is recovered with eight SD fractures (left) and a five-stage fractured horizontal well of the same total fracture surface area (right) according to various embodiments of the present disclosure.
Figure 16B:
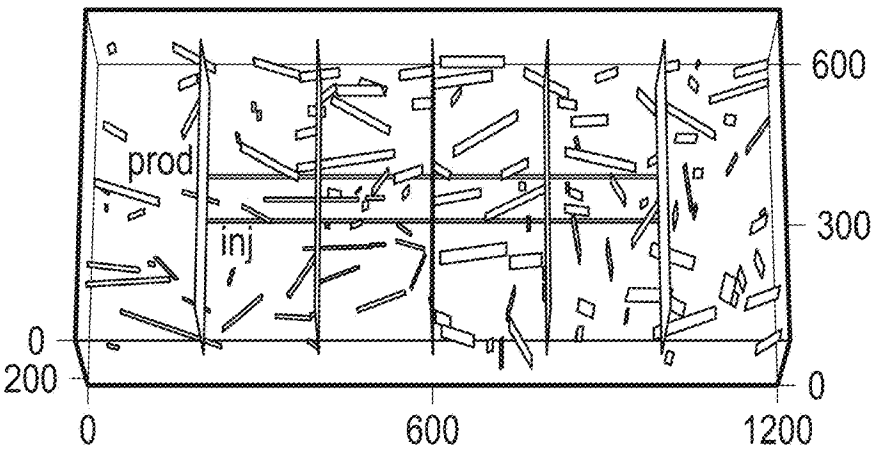
Figure 17B:
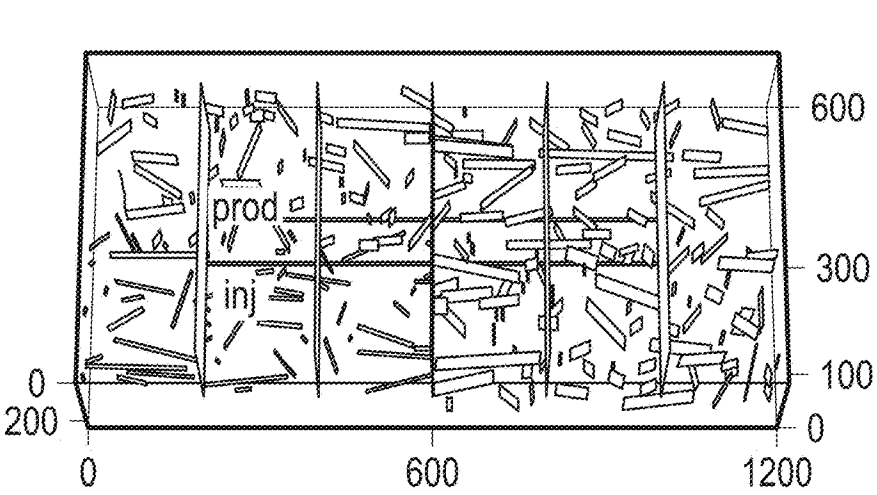
FIGS. 17(*a, b*) show the plot for a naturally fractured reservoir with 375 stochastic natural fractures. The same fractured domain is recovered with eight SD fractures (left) and a five-stage fractured horizontal well of the same total fracture surface area (right) according to various embodiments of the present disclosure.
Figure 17A:
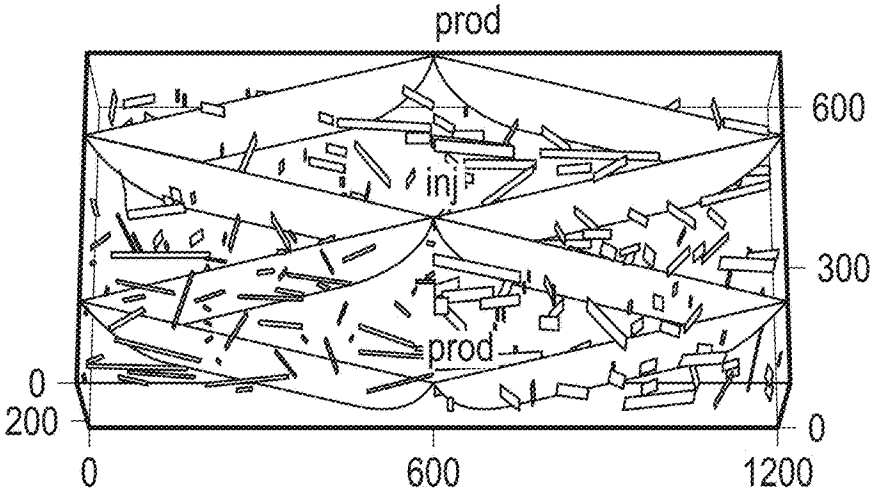

To study the effect of natural fractures (NF) on thermal recovery from EGS, ADFNE was used to generate different realizations of natural fractures. This work used the fully dimensional or explicit fracture model, which involves partitioning each fracture into several fracture cells. Although this approach is very computationally expensive, it is the most accurate approach to model fractured reservoirs. The idea is to obtain high-resolution reference solutions, which can be used to validate the application of other fracture models such as discrete fracture models (DFM), embedded discrete fracture models (EDFM), projection-based embedded discrete fracture models (pEDFM) in EGS. FIG. 16 presents the mesh for a naturally fractured system with 160 natural fractures. In FIG. 16(*a*), the thermal energy in the naturally fractured domain is recovered using the eight SDF triplet configuration, whereas FIG. 16(*b*) uses a five MFHW with the same total fracture surface area. To evaluate the effect of increasing the number of natural fractures, FIG. 17 presents the mesh for a reservoir of the same size but with 375 fractures instead of 160. FIG. 17(*a*) shows a simulation domain for Eight SDF triplet with 375 nature fractures, while FIG. 17(*b*) shows a simulation domain for Five MHF with 375 natural fractures. The thermal recovery was also simulated from this fractured hot rock using the SDF triplet configuration and a corresponding MFHW case.

Figure 18B:
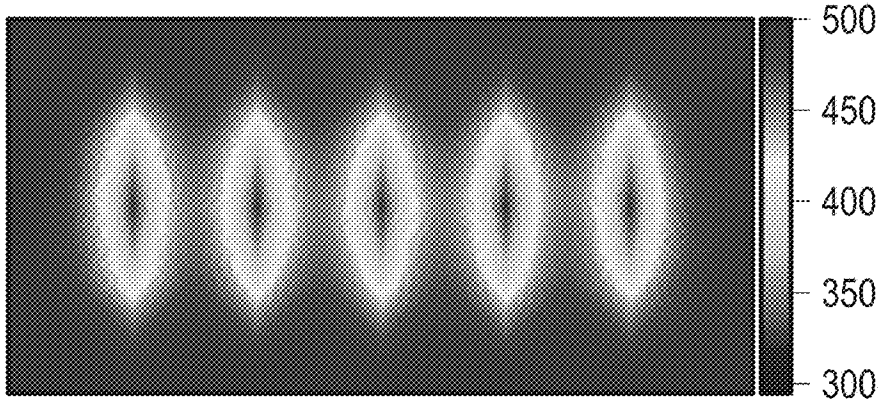
FIGS. 18(*a, b*) show the temperature distribution at the top of the fractured hot rock with 160 NFs, after simulating 50 years of thermal recovery according to various embodiments of the present disclosure.
Figure 18A:
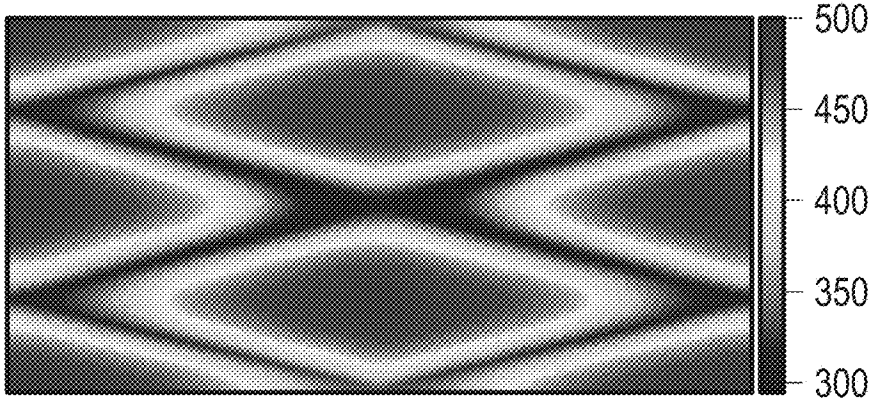

FIG. 18 presents the temperature profile after simulating 50 years of thermal recovery from the fractured hot rock with 160 NFs. FIG. 18(*a*) shows a temperature profile for an SDF 160 NF case at the top of the reservoir, and FIG. 18(*b*) shows a temperature profile for a MFHW 160 NF case at the top of the reservoir. In the images shown in FIGS. 18(*a*) and 18(*b*), the first 150 meters from the top of the reservoir domain were clipped. So, these profiles correspond to the plan view of the lower half of the reservoir domain. From the blue-colored regions of the temperature profiles, it is observable that only the natural fractures connected to the SDF or hydraulic fractures contribute appreciably to the thermal recovery.

Figure 19A:
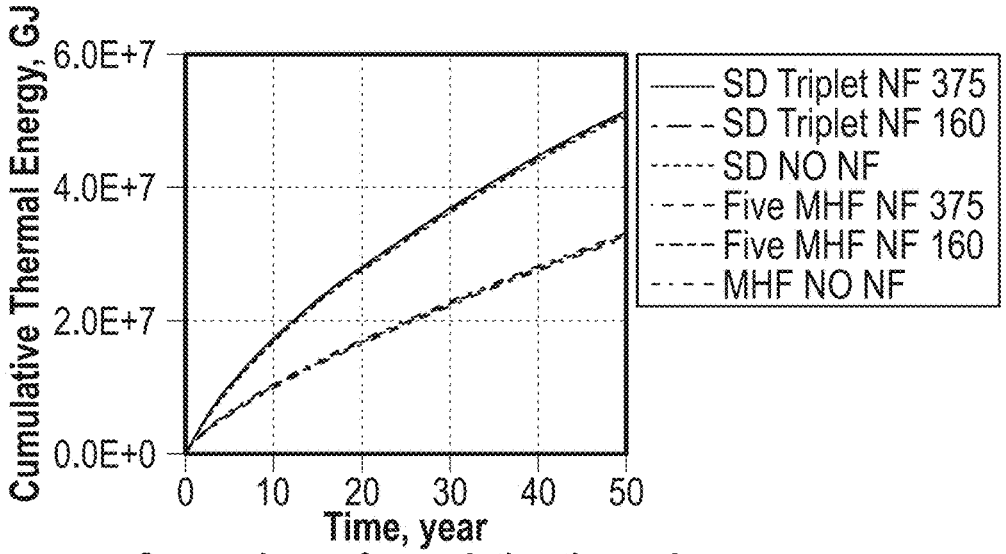
FIGS. 19(*a*)-(*c*) are profiles showing the temperature distribution after simulating the injection and production of water for 50 years according to various embodiments of the present disclosure.
Figure 19B:
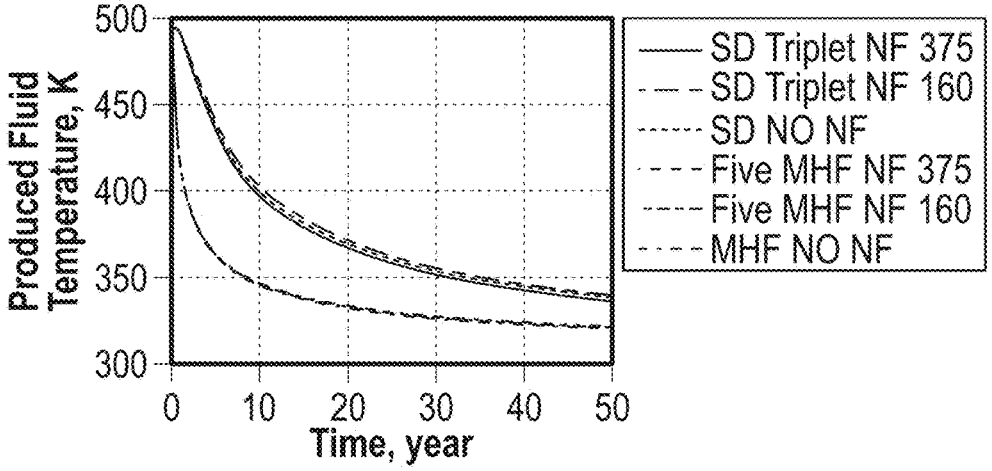
Figure 19C:
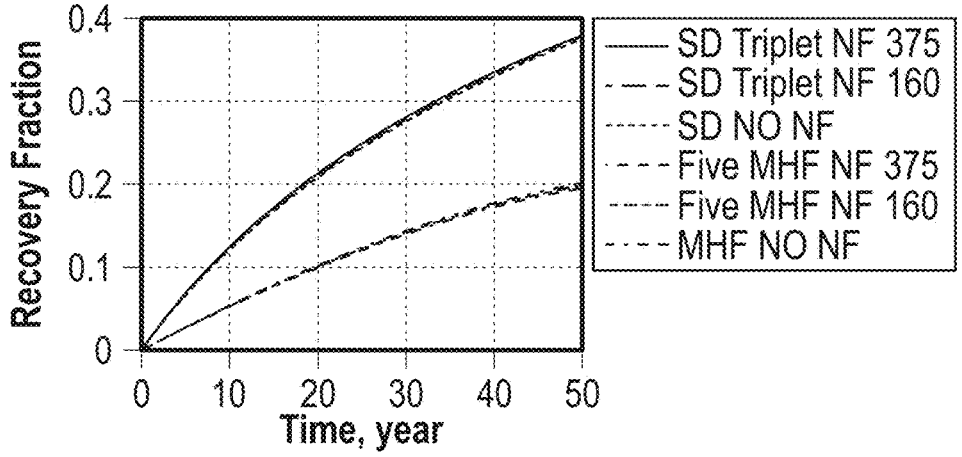

FIG. 19 presents the performance plots for the thermal recovery from the naturally fractured systems presented in this section. FIG. 19(*a*) shows a comparison of cumulative thermal energy for natural fracture cases. FIG. 19(*b*) shows a comparison of produced fluid temperature for natural fracture cases. FIG. 19(*c*) shows a comparison of recovery factor for natural fracture cases. The results indicate no appreciable difference in all the profiles presented for the MFHW cases with no NF, 160 NFs, and 375 NFs. Although no noticeable difference is observed in the cumulative thermal energy and recovery fraction for the SDF cases, a slight difference can be observed in the produced fluid temperature in FIG. 19(*b*). The SDF case with 160 NFs yielded the highest produced fluid temperature, whereas the SDF case with 375 NFs had a produced fluid temperature that was even lower than the SDF case without natural fractures. This interesting result highlights the well-known fact that large conductive natural fractures can short-circuit the produced fluid path. So, a linear increase in the produced fluid temperature is not expected as the number of natural fractures increases. However, it is worth noting that the recovery fraction for all SDF cases is still about the same. This implies that the natural fractures do not curtail the performance of the proposed application of slot-drill fracture technology in enhanced geothermal systems.

Figure 20B:
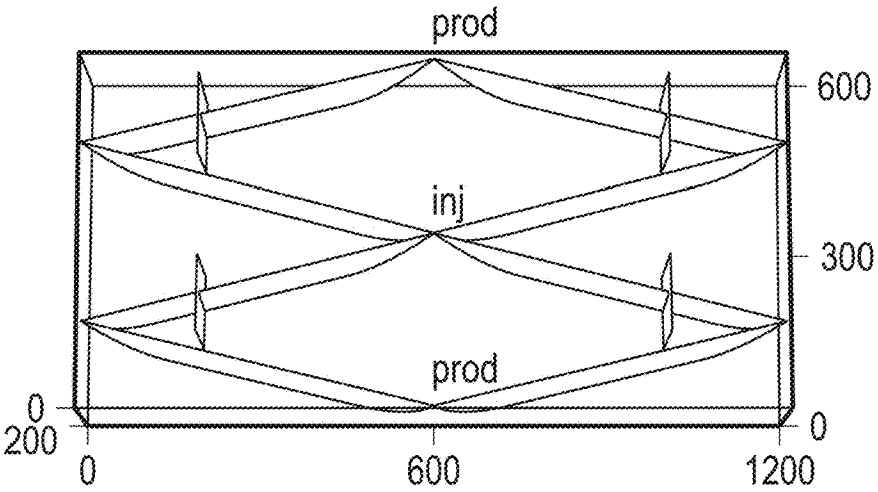
FIGS. 20(*a, b*) show a simulation domain for the study of short circuit of flow through the natural fracture according to various embodiments of the present disclosure.
Figure 20A:
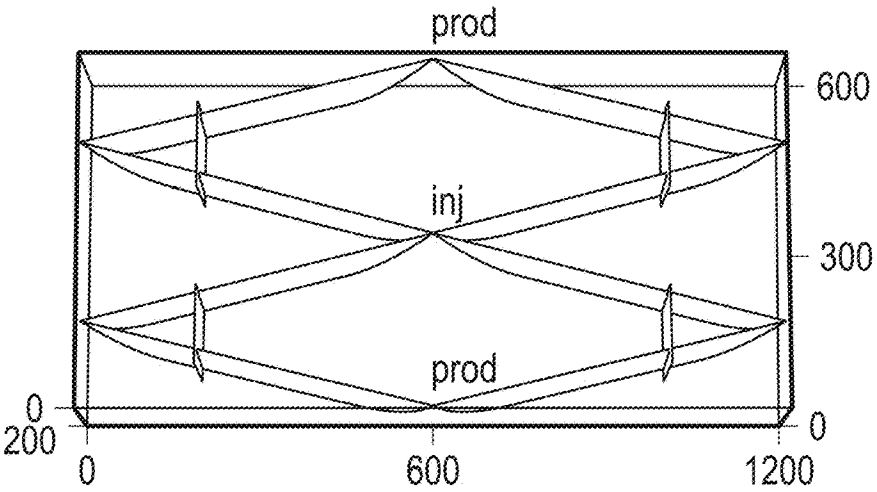

To further investigate the potential of large natural fractures to shortcircuit the desired fluid flow path in SDF EGS, four moderately sized conductive natural fractures were manually placed in the reservoir domain. In FIG. 20(*a*), these four natural fractures are placed in such a way that they short-circuit the desired flow along the path of the intersecting SD fractures. In contrast, they were inserted such that they can enhance the thermal recovery in FIG. 20(*b*). It is worth noting that although the actual location of the natural fractures is fixed in the subsurface, their location can be uncertain. So, it is reasonable to simulate the location of these fractures at different points in the domain. Additionally, we did not bother optimizing the location of the natural fracture because the goal is not to show the most optimum configuration, but to point out the fact that the thermal recovery can either be increased or decreased depending on how the SDFs are located relative to the position of known or mapped natural fractures in the domain.

Figure 21B:
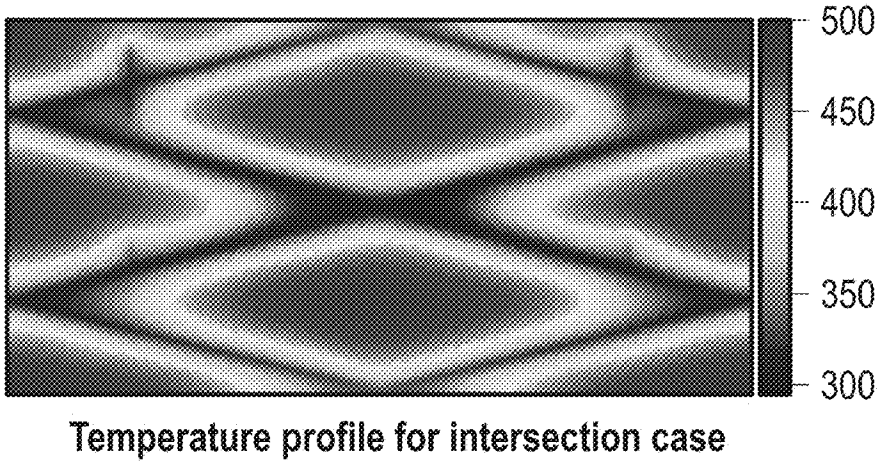
FIGS. 21(*a, b*) show the temperature distribution at the top of the reservoir after simulating the injection and production of water for 50 years according to various embodiments of the present disclosure.
Figure 21A:
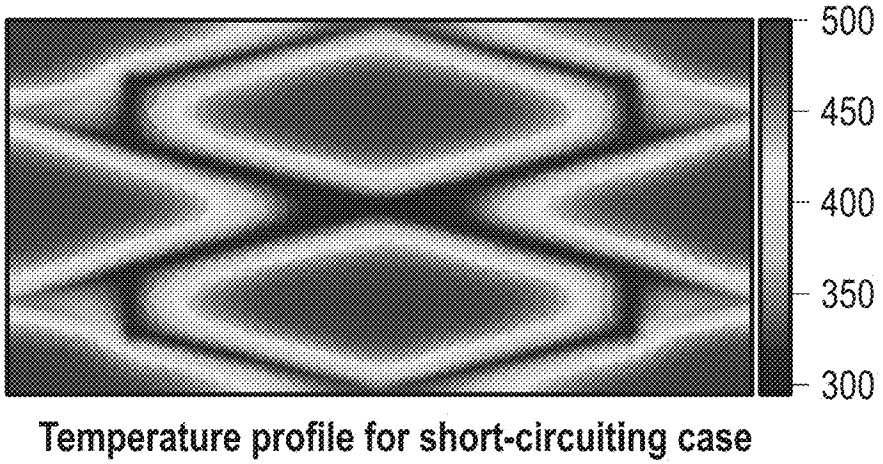

FIG. 21 presents the temperature profiles after simulating the thermal recovery for 50 years from the two cases shown in FIG. 20. The temperature profile in FIG. 21(*a*) indicates that the natural fracture short-circuits the regions where the SDF fractures intersect. This reduces the length of the flow path of the fluid towards the production well and consequently reduces the total surface area of the subsurface rock that the injected water contacts. In contrast, the temperature profile in FIG. 21(*b*) shows that the total surface area that the injected water contacts increases due to the presence of the natural fracture. So, the natural fracture contributes to an increased thermal recovery instead of curtailing thermal recovery due to the short-circuiting of the desired flow path.

Figure 22A:
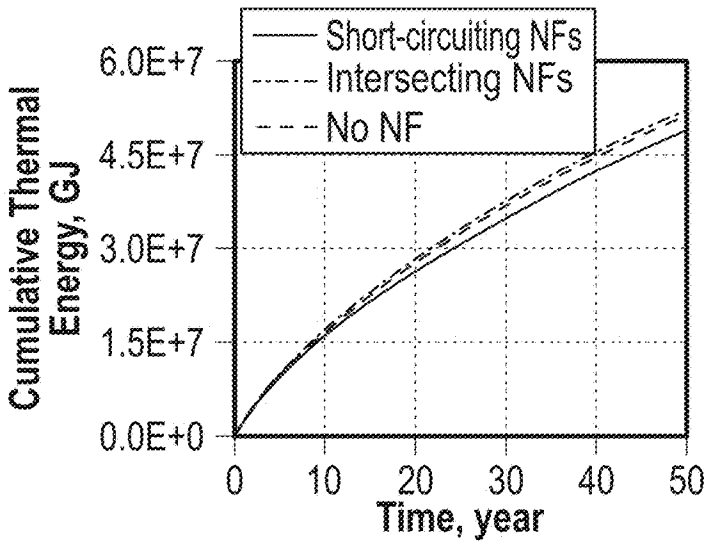
FIGS. 22(*a*)-(*c*) show the simulation results after simulating the injection and production of water for 50 years according to various embodiments of the present disclosure.
Figure 22B:
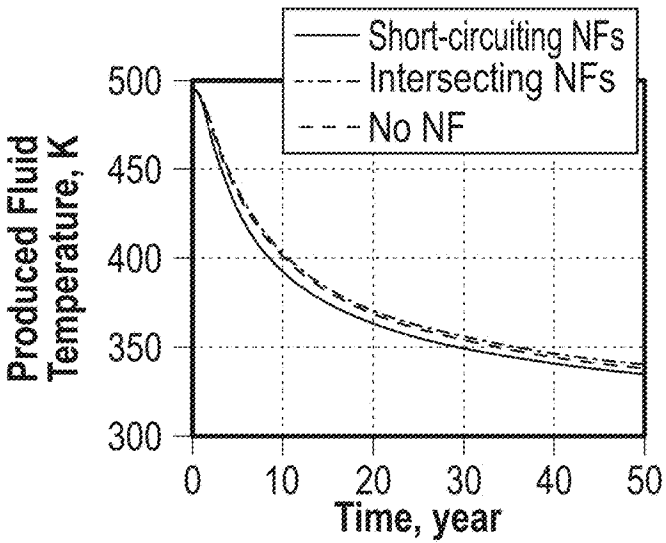
Figure 22C:
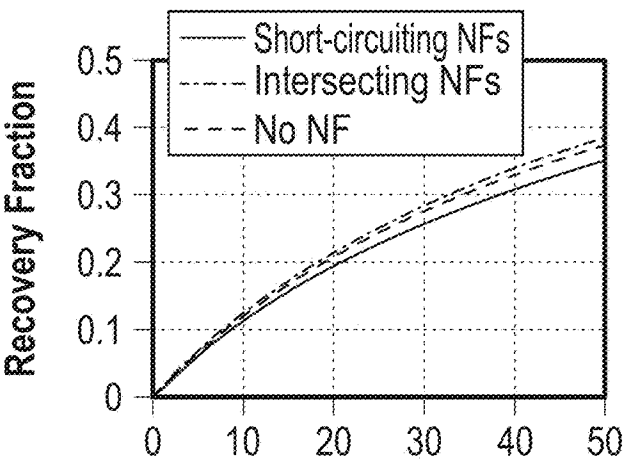

FIG. 22 presents the plots of the cumulative thermal energy, produced fluid temperature, and thermal recovery fraction after simulating heat recovery from the two systems presented in FIG. 20, as well as a case without the four natural fractures. FIG. 22(*a*) shows a comparison of cumulative thermal energy for short circuit cases. FIG. 22(*b*) shows a comparison of produced fluid temperature for short circuit cases. FIG. 22(*c*) show a comparison of recovery factor for short circuit cases. The results show that the thermal recovery fraction is lower in the case of the short-circuiting natural fractures. In contrast, it is slightly higher when the natural fractures are placed in a somewhat different location relative to the SDFs.

Although the location of the natural fractures is fixed in the subsurface, the flexibility in the SD doublet fracture configurations can be leveraged to design the path of the SDFs so that they improve the thermal recovery instead of decreasing it due to a short-circuiting of the desired flow path. In contrast, the lack of control over the path of propagating hydraulic fractures makes it practically impossible to design MFHWs to take advantage of large natural fractures or faults, even when we know their location and orientation from image logs, and seismic and micro-seismic data. Furthermore, performing a similar study of the role of known large natural fractures on MFHWs is considered unnecessary because there is no technology to guarantee that any modeled hydraulic fracture configurations (that intersect the NFs at specific points) can be created in the subsurface.

7. Evaluation of the Use of Slot-Drill Fractures in the Utah FORGE

This section discusses our numerical studies of the applicability of the proposed model by simulating a system representative of the Utah FORGE project. To this end, we obtained the model parameters from topical reports from the Utah FORGE Phase 2C, and these are summarized in Table 3. The thermal recovery from the representative Utah FORGE subsurface rock is modeled using the proposed SD configuration and the current approach, which is based on two pairs of parallel horizontal/deviated wells.

Figure 23A:
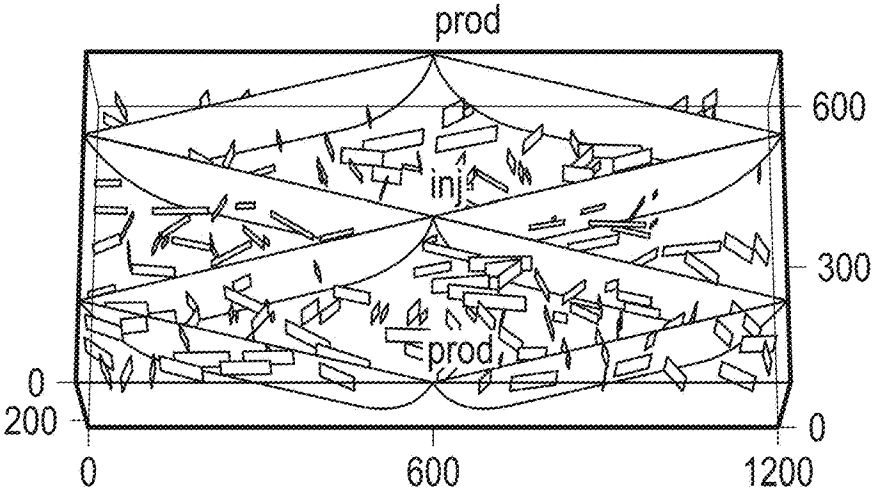
FIGS. 23(*a, b*) show the temperature distribution after simulating the injection and production of water for 50 years according to various embodiments of the present disclosure.
Figure 23B:
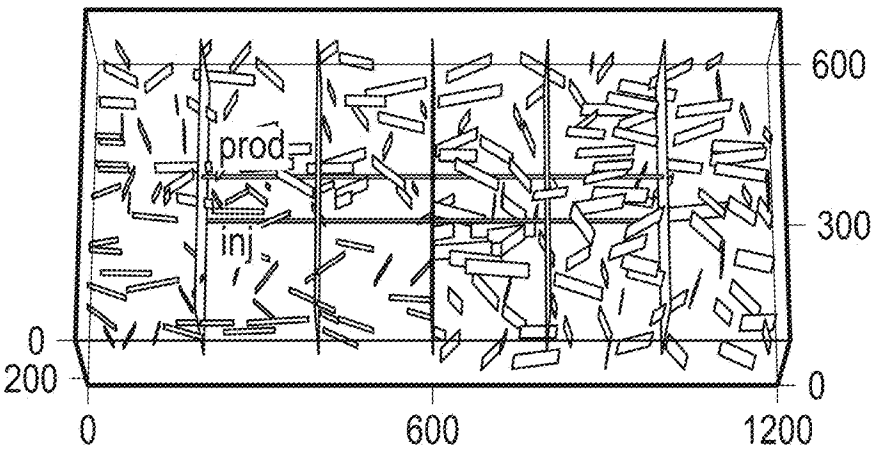

The images in FIGS. 23(*a*) and 23(*b*) show the simulation domain for the SDF and MFHW cases, respectively. The total fracture surface areas in both cases are the same to ensure a reasonable comparison of their thermal recoveries. Considering that the Utah FORGE reservoir is naturally fractured, ADFNE was used to generate a stochastic natural fracture network with 500 natural fractures.

Figure 24B:
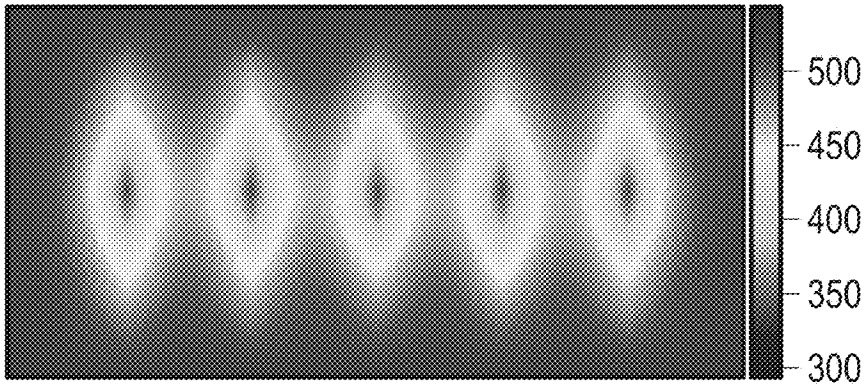
FIGS. 24(*a, b*) show the temperature distribution at the top of the reservoir after simulating the injection and production of water for 50 years according to various embodiments of the present disclosure.
Figure 24A:
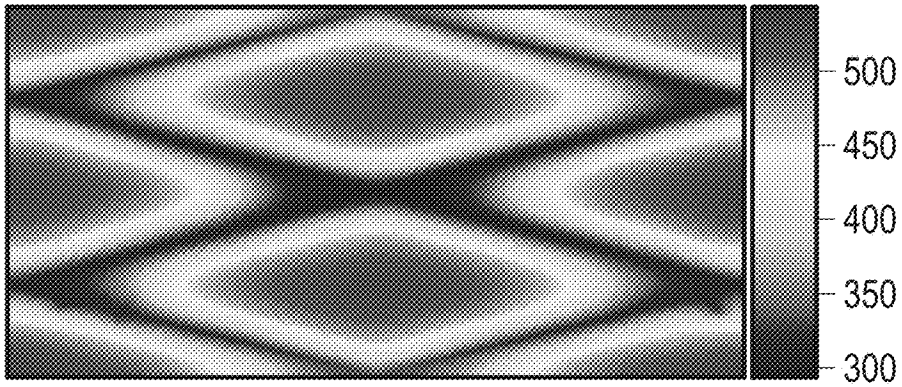

FIG. 24 presents the simulated temperature profiles for applying the SDF and MFHW technologies in a representative Utah FORGE reservoir. FIG. 24(*a*) shows a temperature profile in an SD fracture case for Utah Forge EGS. FIG. 24(*b*) shows a temperature profile in an MHF fracture case for Utah Forge EGS. These profiles indicate that the bright-colored region of the SDF temperature profile is much larger than the correspondingly colored region of the MFHW profile. The larger volume of these regions with lower temperatures after 50 years of simulated thermal recovery also confirms that the proposed technology can recover more heat from the hot fractured rocks in the subsurface.

Figure 25A:
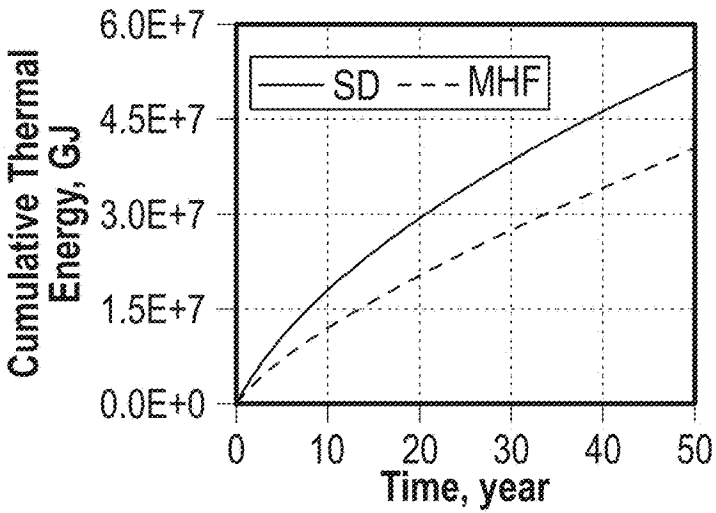
FIGS. 25(*a*)-(*c*) show that the proposed SD fracture system significantly outperforms the multistage fractured horizontal well according to various embodiments of the present disclosure.
Figure 25B:
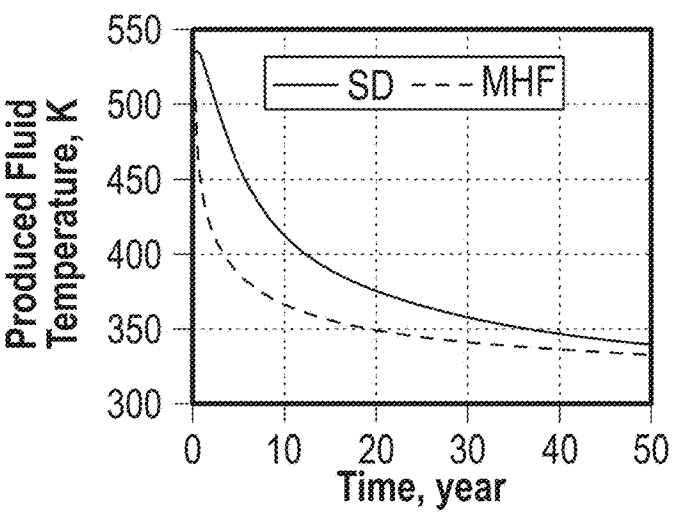
Figure 25C:
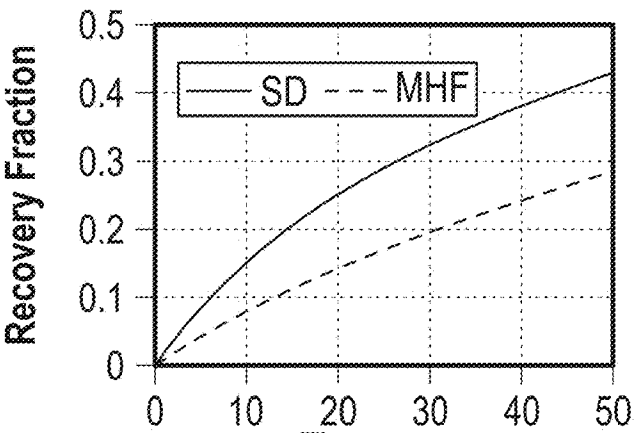

The plots of the cumulative thermal energy, produced fluid temperature, and thermal recovery fraction are given in FIGS. 25(*a*), 25(*b*), and 25(*c*), respectively. These results show that the thermal recovery fraction of the proposed technology is 50% higher than that of the state-of-the-art technology, which is currently being used in the Utah FORGE project. As explained in the previous section, the difference in the cumulative thermal energy is smaller because the same volume of water is injected and produced in both cases. However, the produced fluid temperature is considerably higher in the SDF case, resulting in its much higher thermal recovery fraction.

8. Conclusions

This paper presents high-resolution numerical simulation studies of the performance of the state-of-the-art MFHW approach to recover heat from EGS compared to our proposed approach that uses slot-drilled fractures. The performance plots and temperature profiles for all the simulated cases show that the proposed approach significantly outperforms the MFHW approach to different degrees, depending on the configuration of the SD fracture system and the model parameters. The proposed technology yields a 50% higher thermal recovery fraction for the representative Utah FORGE field case simulated. Other conclusions based on the various cases simulated can be summarized as follows:

- The SD fracture doublet appears to be the most promising of the SDF EGS configurations proposed because it uses the fewest wells per unit reservoir volume, and its recovery is only slightly lower than that of the corresponding SDF triplet configuration. This, coupled with the flexibility it offers regarding the optimization of the number of SDFs per unit volume, makes it a lower-cost, higher-profit, and more flexible alternative to the proposed SDF triplet configuration.
- The results from the natural stochastic fracture systems studied indicates that the contribution of natural fractures to heat recovery is minimal. However, the SDF doublet configuration can be designed to avoid being short-circuited by large natural fractures or faults known to be present in the hot rock.
- The control over the location, size, orientation, and aperture of the slot-drilled fractures provides more reliability in terms of comparing the system modeled to the actual EGS in the subsurface. In contrast, the actual MFHW system could be a lot less efficient than the simulated system because of the lack of control over the size, orientation, and geometry of the hydraulic fractures. There is also no guarantee that the injection and production wells will intersect all the hydraulic fractures.

TABLE 3

Parameters used in the Utah Forge case study

| Reservoir parameters | Value | Unit |
|---|---|---|
| Matrix permeability | $1e^{-18}$ | $m^2$ |
| Matrix porosity | 0.001 | — |
| Fracture permeability | 9.8692e−12 | $m^2$ |
| Fracture porosity | 0.0.015 | — |
| Fracture spacing in MHF | 200 | m |
| Fracture aperture | 0.05 | m |
| Total fracture volume | $6.96e^6$ | $m^3$ |
| Reservoir dimensions | 1200 × 600 × 250 | m |
| Initial reservoir pressure | $28e^6$ | Pa |
| Initial reservoir temperature | 536 | K |
| Injected fluid temperature | 293 | K |
| Constant injection rate | 0.069 | $m^3/s$ |
| Constant producer bhp | $25e^6$ | Pa |
| Rock thermal properties | | |
| Rock thermal conductivity | 3.05 | W/(m K) |
| Rock density | 2750 | $Kg/m^3$ |
| Heat capacity | 790 | J/Kg K |
| Fluid properties | | |
| Fluid thermal conductivity | 0.6 | W/(m K) |
| Fluid heat capacity | 4200 | J/Kg K |

TABLE 3-continued

| Parameters used in the Utah Forge case study | | |
|---|---|---|
| Reservoir parameters | Value | Unit |
| Coefficient of thermal expansion | $207e^{-6}$ | K-1 |
| Fluid compressibility | $2.5e^{-12}$ | 1/Pa |
| Fluid density | 1000 | $Kg/m^3$ |
| Fluid viscosity | $0.5e^{-3}$ | Pa-s |

For completeness, it is worth clarifying that the single-phase formulation used in this work implies that the results are only directly applicable to low-enthalpy geothermal reservoirs. However, we do not expect the conclusions on the performance of the proposed technology relative to the state-of-the-art approach to change due to multiphase flow and the presence of salts and other impurities. Mechanical deformation can lead to a reduction in fracture conductivity over time if the pore pressure decreases considerably, but the continued injection of water during this process, as well as the availability of proppants, make this relatively less important.

9. Supplemental

S-1. Six SDF Doublet

This section presents the simulation results for the six SDF doublet series and parallel configurations. The results show that the SDF doublet parallel configuration yields slightly lower cumulative thermal energy and produced fluid temperature than the series configuration. In contrast, the SDF doublet parallel configuration yields a marginally higher thermal recovery fraction than its corresponding series configuration. This SDF series configuration's slightly higher produced fluid temperature could be due to the pressure-volume work, as evidenced by the increase in the injection and near-fracture pressures (up to 1.5 times the initial reservoir pressure). From equation 15, the higher produced fluid temperature in the SDF series configuration results in increased wellhead enthalpy and cumulative thermal energy. Conversely, we observed that the volume-weighted average temperature after 50 years of heat extraction is 428 and 427 K for the SDF doublet series and parallel cases, respectively. The observed higher thermal recovery fraction of the SDF doublet parallel case is consistent with equation 12, which indicates that the case with the lower average temperature yields a higher recovery fraction.

S-2. Fourteen SDF Doublet

This section presents the result of the extended doublet case with fourteen slot drill fractures. Although the cumulative thermal energy and produced fluid temperature are higher in the series configuration, its thermal recovery fraction is lower. The artificially higher cumulative thermal energy and produced fluid temperature in the series configuration is because the injection pressure increases to two times the initial reservoir temperature in the series configuration. These high-pressure values induce pressure-volume work, resulting in higher cumulative thermal energy and fluid temperature. However, the average temperatures of the 14 SDF doublet series and parallel configurations are 386 and 382 K, respectively, after 50 years of thermal energy production. So, the thermal recovery fraction, as described by equation 12, is still higher in the parallel configuration than in the series configuration.

Figure 26B:
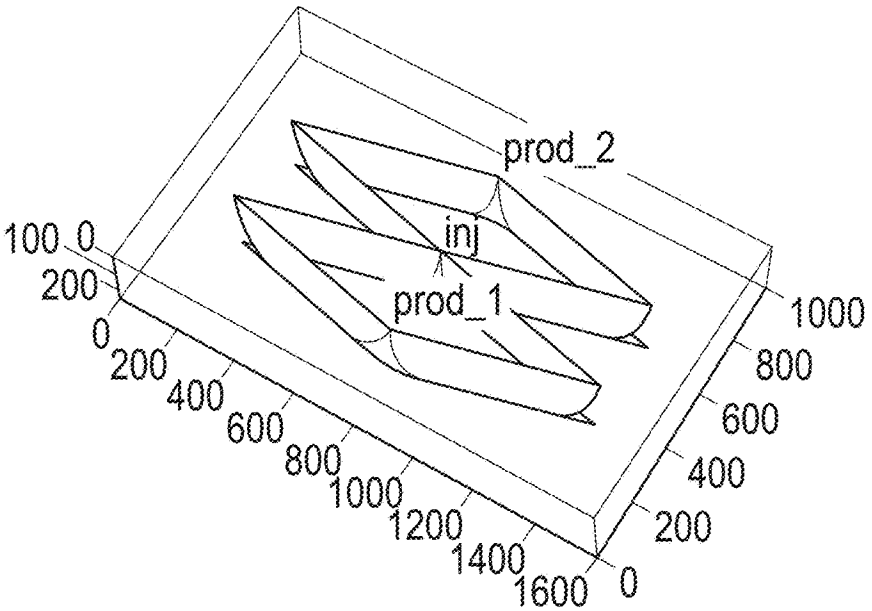
FIGS. 26(*a, b*) shows an extended grid for the MFHW case and the SDF triplet case with and without constant temperature boundary conditions according to various embodiments of the present disclosure.
Figure 26A:
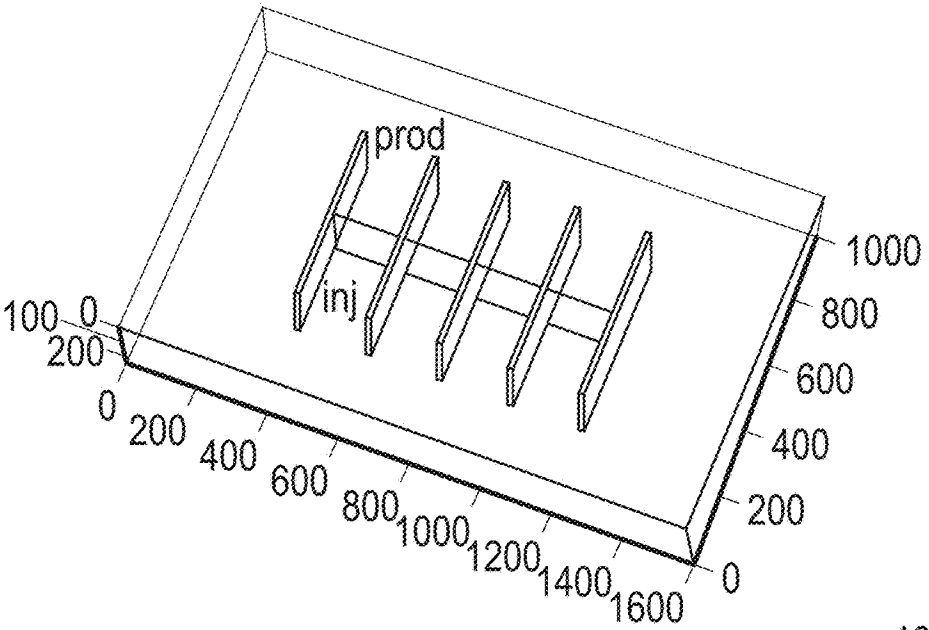
Figure 27B:
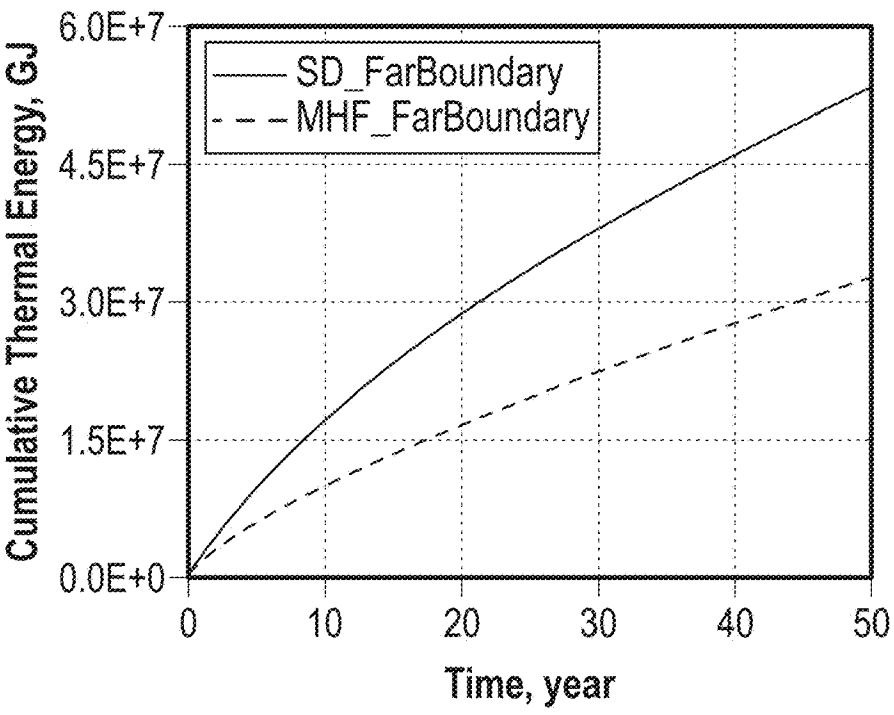
FIGS. 27(*a, b*) shows the thermal recovery fraction and cumulative thermal energy plots for the expanded grid cases that have no-flow and insulated boundary conditions according to various embodiments of the present disclosure.
Figure 27A:
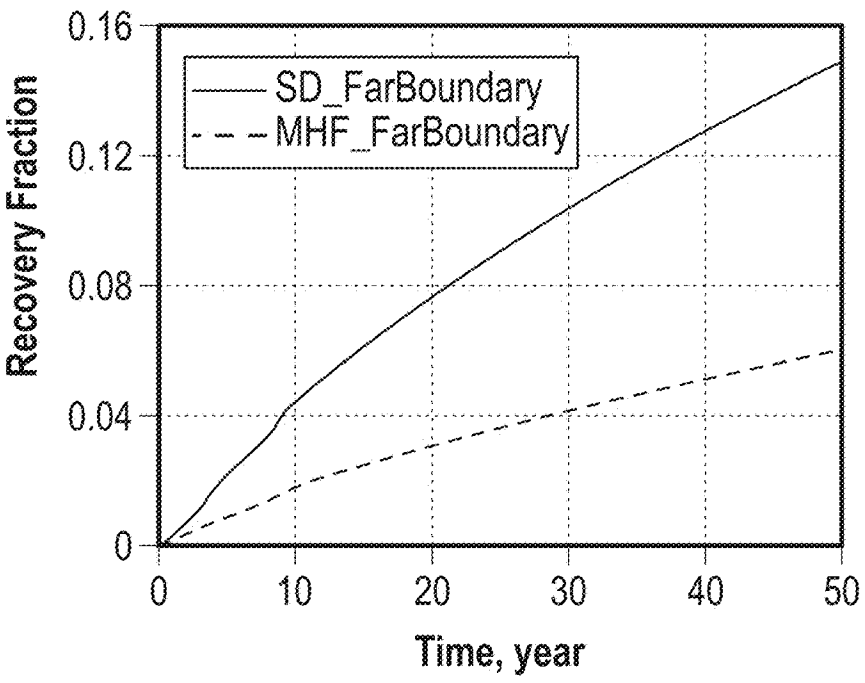
Figure 28B:
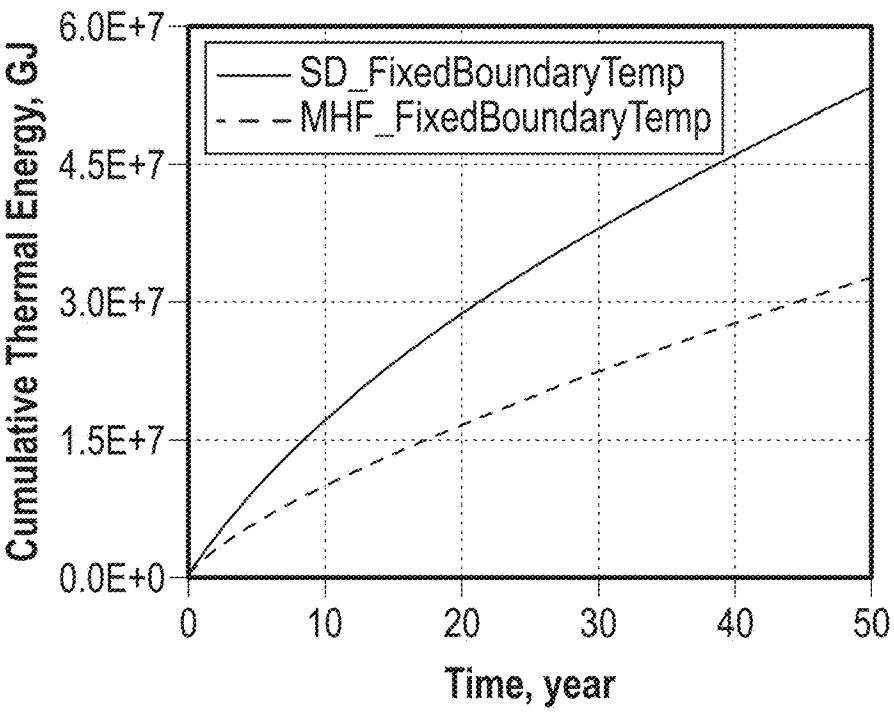
FIGS. 28(*a, b*) shows the thermal recovery fraction and cumulative thermal energy plots for the expanded grid cases that have no-flow and constant-temperature boundary conditions.
Figure 28A:
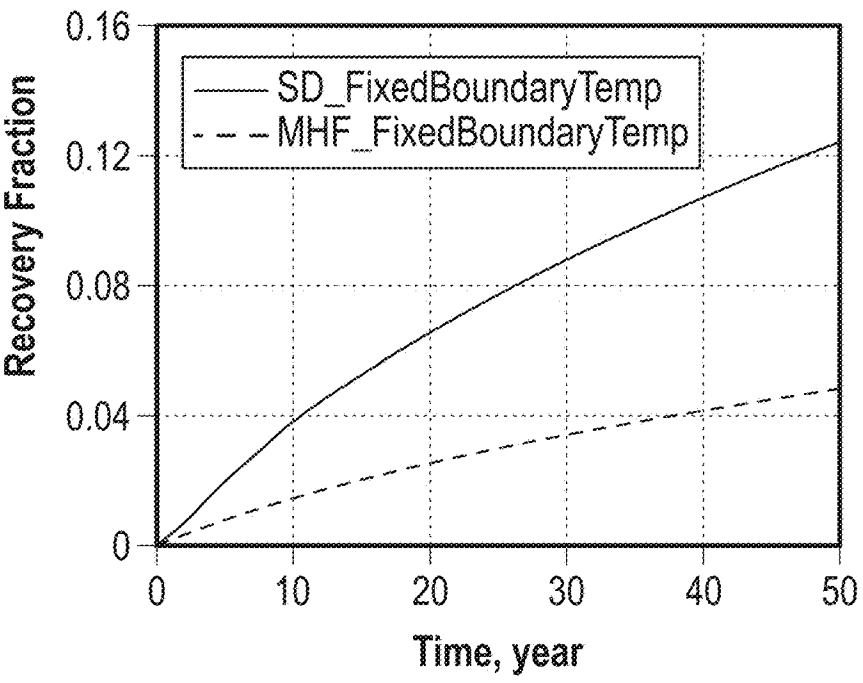

S-3. Evaluation of EGS Performance Under Constant Temperature Boundary Conditions Although all simulations presented in the manuscript used no-flow and fully insulated boundary conditions, the trend in the results remains unchanged if the temperature is instead maintained constant on the outer faces of the simulation domain. To achieve this, the domain shown in FIG. 6 was padded with a few more matrix cells in the x- and y-directions. Without this padding, the SDF production wells will be on the constant temperature boundary cell, leading to artificially high temperatures throughout the simulation duration, which is not representative of what to expect in the subsurface. The enlarged domain in the x- and y-directions is shown in FIGS. 26(*a*) and 26(*b*), respectively. FIGS. 27(*a*), 27(*b*), 28(*a*) and 28(*b*) show the results for the cases with insulated and constant-temperature boundaries, respectively, and the results show that the SDF case still outperforms the MHF case.

In addition to the forgoing, the various embodiments of the present disclosure include, but are not limited to, the embodiments set forth in the following clauses.

Clause 1—A method, comprising drilling at least one injection well bore; cutting at least a first slot at an angle to the injection well bore, the first slot having a first end connected to the injection well bore and a distal end; cutting at least a second slot at an angle to the injection well bore, the second slot having a first end connected to the distal end of the first slot and a distal end; and drilling at least one production well bore, the production well bore being connected to the distal end of the second slot.

Clause 2—The method of clause 1, further comprising warming a stream of water by injecting the stream of water into the injection well bore, flowing the stream of water through the first slot and the second slot, and collecting the stream of water from the production well bore.

Clause 3—The method of clause 1 or 2, wherein the first slot is cut in a first direction away from the injection well bore, and the second slot is cut in a second direction, the second direction being different from the first direction.

Clause 4—The method of any of clauses 1-3, further comprising cutting a plurality of interconnected slots, the plurality of interconnected slots being disposed in series between the first slot and the second slot.

Clause 5—The method of any of clauses 1-4, wherein the slots are cut in a repeating pattern, the pattern being configured to optimize coverage of an area between the injection well bore and the production well bore.

Clause 6—The method of any of clauses 1-5, wherein the slots are cut using slot-drill technology.

Clause 7—The method of any of clauses 1-6, wherein the slots are of substantially uniform surface area.

Clause 8—The method of any of clauses 1-7, wherein the slots are configured to intercept at least one naturally-occurring fracture.

Clause 9—A system configured to perform the method of any of clauses 1-8.

Clause 10—A system, comprising an injection well bore; and at least a first plurality of slots connected in series, the first plurality of slots having a first end connected to the injection well bore and a second end connected to at least a first production well bore.

Clause 11—The system of clause 10 further comprising a second plurality of slots connected in series, the second plurality of slots having a first end connected to the injection well bore and a second end connected to a second production well bore.

Clause 12—The system of clause 10 or 11 wherein individual slots of the plurality of slots are cut in a direction away from the injection well bore.

Clause 13—The system of any of clauses 10-12 wherein the plurality of slots are cut in a repeating pattern, the pattern being configured to optimize coverage of an area between the injection well bore and the production well bore.

Clause 14—The system of any of clauses 10-13 wherein the plurality of slots are cut using slot-drill technology.

Clause 15—The system of any of clauses 10-14 wherein the slots are of substantially uniform surface area.

Clause 16-A system comprising an injection well bore being configured to receive a stream of water; at least a first slot substantially perpendicular to the injection well bore, the first slot having a first end and a distal end, the first end of the first slot being connected to the injection well bore such that the stream of water flows from the injection well bore into the first slot; at least a second slot substantially perpendicular to the injection well bore, the second slot having a first end and a distal end, the first end of the second slot being connected to the distal end of the first slot such that the stream of water flows from the first slot into the second slot; and at least one production well bore, the production well bore being connected to the distal end of the second slot such that the stream of water flows from the second slot into the production well bore.

Clause 17—The system of clause 16 wherein the injection well bore and the production well bore are substantially vertical.

Clause 18—The system of clause 16 or 17 further comprising at least a first plurality of slots connected in series such that water flows through the plurality of slots, the first plurality of slots having a first end connected to the injection well bore and a second end connected to a second production well bore.

Clause 19—The system of any of clauses 16-18 further comprising a plurality of slots connected in series, the plurality of slots being disposed between the first slot and the second slot.

Clause 20—The system of any of clauses 16-19 wherein the first slot, the second slot, and the plurality of slots are cut in a repeating pattern, the pattern being configured to optimize coverage of an area between the injection well bore and the production well bore.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. In an embodiment, "about 0" can refer to 0, 0.001, 0.01, or 0.1. In an embodiment, the term "about" can include traditional rounding according to significant figures of the numerical value. In addition, the phrase "about 'x' to 'y'" includes "about 'x' to about 'y'".

It should be emphasized that the above-described embodiments of the present disclosure are merely possible examples of implementations, and are set forth only for a clear understanding of the principles of the disclosure. Many variations and modifications may be made to the above-described embodiments of the disclosure without departing substantially from the spirit and principles of the disclosure. All such modifications and variations are intended to be included herein within the scope of this disclosure.

Therefore, the following is claimed:

1. A method, comprising:

drilling an injection well bore;

cutting a first slot at a first angle to the injection well bore, the first slot having a first end directly connected to the injection well bore and an opposing distal end on the opposite end of the first slot;

cutting a second slot at a second angle to the injection well bore, the second slot has a first end and an opposing distal end on the opposite side the second slot, the second slot having the first end connected to the distal end of the first slot, wherein the first slot intersects and is directly interconnected with the second slot so that the first slot and second slot are in series with one another, the distal end of the second slot connected to a slot cutter well bore, cutting a series of additional slots comprising additional slot cutter well bores continuing from the distal end of the second slot;

drilling a production well bore, the production well bore being directly connected to an end of the last slot of the series of additional slots, wherein the injection well bore, the first slot, the second slot, the series of additional slots, and the production well bore are serially connected to flow a fluid from the injection well bore through the first slot, the second slot, and the series of additional slots, to the production well bore.

2. The method of claim 1, further comprising warming a stream of water by:

injecting the stream of water into the injection well bore, flowing the stream of water through the first end of the first slot to the distal end of the first slot and into the first end the second slot to the distal end of the second slot, and collecting the stream of water from the production well bore.

3. The method of claim 1, wherein the first slot is cut in a first direction away from the injection well bore, and the second slot is cut in a second direction, the second direction being different from the first direction.

4. The method of claim 1, wherein the first slot, the second slot, and the series of additional slots are cut using slot-drill technology.

5. The method of claim 1, wherein the first slot, the second slot, and the series of additional slots are of substantially uniform surface area.

6. The method of claim 1, wherein the first slot, the second slot, and the series of additional slots are configured to intercept at least one naturally-occurring fracture.

7. A system comprising:

drilling an injection well bore being configured to receive a stream of water;

cutting a first slot at a first angle to the injection well bore, the first slot having a first end and an opposing distal end, the first end of the first slot being directly connected to the injection well bore such that the stream of water flows from the injection well bore into the first slot;

cutting a second slot at a second angle to the injection well bore, the second slot having a first end and an opposing distal end, the first end of the second slot intersecting and being directly connected to the distal end of the first slot such that the stream of water flows from the distal end of the first slot directly into the first end of the second slot, wherein the first slot and the second slot are connected in series with one another, wherein the distal end of the second slot connected to a slot cutter well bore, cutting a series of additional slots comprising additional slot cutter well bores continuing from the distal end of the second slot; and drilling a production well bore, the production well bore being directly connected to an end of the last slot of the series of additional slots such that the stream of water flows from the injection well bore through the first slot, the second slot, and the series of additional slots, to the production well bore.

8. The system of claim 7, wherein the injection well bore and the production well bore are substantially vertical and are connected serially by the first slot, the second slot, and the series of additional slots.

9. The system of claim 7, wherein the first slot, the second slot, and the series of additional slots are cut in a repeating pattern, the pattern being configured to optimize coverage of an area between the injection well bore and the production well bore.

* * * * *